US011098389B2

(12) United States Patent
Hattendorf et al.

(10) Patent No.: US 11,098,389 B2
(45) **Date of Patent: *Aug. 24, 2021**

(54) HARDENED NICKEL-CHROMIUM-TITANIUM-ALUMINUM ALLOY WITH GOOD WEAR RESISTANCE, CREEP RESISTANCE, CORROSION RESISTANCE AND WORKABILITY

(71) Applicant: VDM Metals International GmbH, Werdohl (DE)

(72) Inventors: Heike Hattendorf, Werdohl (DE); Jutta Kloewer, Duesseldorf (DE)

(73) Assignee: VDM Metals International GmbH, Werdohl (DE)

( * ) Notice: Subject to any disclaimer, the term of this patent is extended or adjusted under 35 U.S.C. 154(b) by 41 days.

This patent is subject to a terminal disclaimer.

(21) Appl. No.: 15/104,306

(22) PCT Filed: Jan. 12, 2015

(86) PCT No.: PCT/DE2015/000009

§ 371 (c)(1),
(2) Date: Jun. 14, 2016

(87) PCT Pub. No.: WO2015/117585

PCT Pub. Date: Aug. 13, 2015

(65) Prior Publication Data

US 2016/0312341 A1 Oct. 27, 2016

(30) Foreign Application Priority Data

Feb. 4, 2014 (DE) ..... 10 2014 001 329.4

(51) Int. Cl.
*C22C 19/05* (2006.01)
*F01L 3/02* (2006.01)

(52) U.S. Cl.
CPC ..... *C22C 19/053* (2013.01); *C22C 19/058* (2013.01); *F01L 3/02* (2013.01)

(58) Field of Classification Search
CPC ... C22C 19/053; C22C 19/055; C22C 19/056; C22C 19/058; F01L 3/02
See application file for complete search history.

(56) References Cited

U.S. PATENT DOCUMENTS 3,573,901 A * 4/1971 Economy ..... C22C 19/053 420/448
4,631,169 A 12/1986 Isobe et al.
(Continued)

FOREIGN PATENT DOCUMENTS

CA 2 392 754 A1 6/2001
CN 1147560 A 4/1997
(Continued)

OTHER PUBLICATIONS

International Search Report of PCT/DE2015/000009, dated Aug. 18, 2015.
(Continued)

*Primary Examiner* — John A Hevey
(74) *Attorney, Agent, or Firm* — Collard & Roe, P.C.

(57) ABSTRACT

Hardened nickel-chromium-titanium-aluminum wrought alloy contains, (in mass %) 5-35% chromium, 1.0-3.0% titanium, 0.6-2.0% aluminum, 0.005-0.10% carbon, 0.0005-0.050% nitrogen, 0.0005-0.030% phosphorus, max. of each (next eleven) 0.010% sulfur 0.020% oxygen 0.70% silicon 2.0% manganese 0.05% magnesium 0.05% calcium 2.0% molybdenum 2.0% tungsten 0.5% niobium 0.5% copper 0.5% vanadium, 0-20% Fe, 0-15% cobalt, 0-0.20% Zr, 0.0001-0.008% boron, the remainder nickel and usual impurities. The nickel content is greater than 35%.
(Continued)

Figure 1:
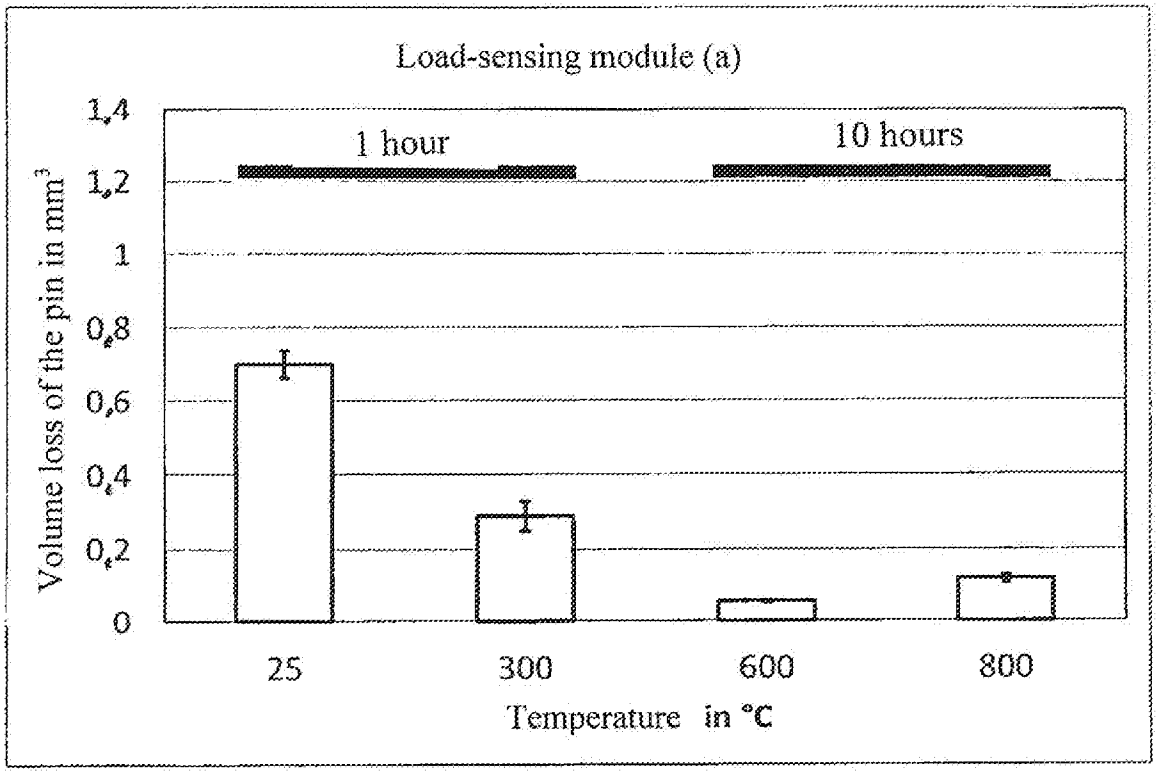

Cr+Fe+Co≥26% fh≥0 fh=6.49+3.88 Ti+1.36 Al−0.301 Fe+(0.759−0.0209 Co) Co−0.428 Cr−28.2 C.

11 Claims, 13 Drawing Sheets

(56) References Cited

U.S. PATENT DOCUMENTS

| | | | | |
|---|---|---|---|---|
| 4,793,970 | A | 12/1988 | Niimi et al. | |
| 4,882,125 | A | 11/1989 | Smith et al. | |
| 5,543,109 | A | 8/1996 | Senba et al. | |
| 5,755,897 | A | 5/1998 | Brill | |
| 5,980,821 | A | 11/1999 | Brill | |
| 5,997,809 | A | 12/1999 | Smith et al. | |
| 6,039,919 | A | 3/2000 | Nagashima et al. | |
| 6,193,822 | B1 * | 2/2001 | Nagashima | F01L 3/02 148/677 |
| 6,458,318 | B1 | 10/2002 | Nishiyama et al. | |
| 6,491,769 | B1 | 12/2002 | Smith et al. | |
| 6,623,869 | B1 * | 9/2003 | Nishiyama | B32B 15/01 138/143 |
| 6,761,854 | B1 | 7/2004 | Smith et al. | |
| 6,852,177 | B2 | 2/2005 | Kubota et al. | |
| 7,651,575 | B2 | 1/2010 | Sawford et al. | |
| 8,470,106 | B2 | 6/2013 | Cloue et al. | |
| 8,568,901 | B2 | 10/2013 | Kiser et al. | |
| 8,632,614 | B2 | 1/2014 | Moeller et al. | |
| 8,696,836 | B2 | 4/2014 | Takahata et al. | |
| 9,011,764 | B2 | 4/2015 | Kloewer et al. | |
| 9,249,482 | B2 | 2/2016 | Jakobi et al. | |
| 9,650,698 | B2 * | 5/2017 | Hattendorf | C22C 19/053 |
| 2003/0164213 | A1 | 9/2003 | Ueta et al. | |
| 2004/0184946 | A1 | 9/2004 | Tominaga et al. | |
| 2005/0129567 | A1 | 6/2005 | Kirchheiner et al. | |
| 2006/0157171 | A1 | 7/2006 | Ueta et al. | |
| 2006/0207696 | A1 | 9/2006 | Takahata et al. | |
| 2007/0144622 | A1 * | 6/2007 | Flahaut | C22C 19/055 148/419 |
| 2010/0092301 | A1 | 4/2010 | Scarlin | |
| 2010/0166594 | A1 | 7/2010 | Hirata et al. | |
| 2010/0310412 | A1 * | 12/2010 | Kloewer | C22C 19/055 420/448 |
| 2015/0050182 | A1 | 2/2015 | Hattendorf | |
| 2015/0093288 | A1 | 4/2015 | Hattendorf | |
| 2016/0108501 | A1 | 4/2016 | Jakobi et al. | |
| 2016/0289807 | A1 * | 10/2016 | Hattendorf | C22C 19/05 |
| 2016/0319402 | A1 * | 11/2016 | Hattendorf | C22C 19/05 |

FOREIGN PATENT DOCUMENTS

| | | | |
|---|---|---|---|
| CN | 1391517 | A | 1/2003 |
| CN | 1463296 | A | 12/2003 |
| CN | 1742106 | A | 3/2006 |
| CN | 1831165 | A | 9/2006 |
| CN | 101484597 | A | 7/2009 |
| CN | 101600814 | A | 12/2009 |
| CN | 101896630 | A | 11/2010 |
| CN | 103080346 | A | 5/2013 |
| DE | 35 11 860 | A1 | 10/1985 |
| DE | 600 04 737 | T2 | 6/2004 |
| DE | 10 2009 049 018 | A1 | 4/2010 |
| DE | 10 2012 011 162 | A1 | 12/2013 |
| EA | 201170560 | A1 | 12/2011 |
| EP | 0 508 058 | A1 | 10/1992 |
| EP | 0 535 888 | A1 | 4/1993 |
| EP | 0 549 286 | B1 | 6/1993 |
| EP | 0 639 654 | A2 | 2/1995 |
| EP | 1 464 718 | A1 | 10/2004 |
| EP | 1 696 108 | A1 | 8/2006 |
| EP | 1 698 708 | A1 | 9/2006 |
| JP | S47-20813 | U | 11/1972 |
| JP | S48-10695 | B1 | 4/1973 |
| JP | S50-109812 | A | 8/1975 |
| JP | S58-117848 | A | 7/1983 |
| JP | S60-70155 | A | 4/1985 |
| JP | S61-284558 | A | 12/1986 |
| JP | H01-312051 | A | 12/1989 |
| JP | H05-269583 | A | 10/1993 |
| JP | H07-11366 | A | 1/1995 |
| JP | H07-216511 | A | 8/1995 |
| JP | H08-127848 | A | 5/1996 |
| JP | H10-8924 | A | 1/1998 |
| JP | H10-219377 | A | 8/1998 |
| JP | H11-22427 | A | 1/1999 |
| JP | 2000-328163 | A | 11/2000 |
| JP | 2002-003970 | A | 1/2002 |
| JP | 2002-531709 | A | 9/2002 |
| JP | 2003-073763 | A | 3/2003 |
| JP | 2003-138334 | A | 5/2003 |
| JP | 2004-277860 | A | 10/2004 |
| JP | 2006-225756 | A | 8/2006 |
| JP | 2009-052084 | A | 3/2009 |
| JP | 2010-510074 | A | 4/2010 |
| JP | 2011-506711 | A | 3/2011 |
| JP | 2011506771 | A | 3/2011 |
| JP | 2011121088 | A | 6/2011 |
| RU | 2125110 | C1 | 1/1999 |
| WO | 01/53548 | A2 | 7/2001 |
| WO | 2008/007190 | A2 | 1/2008 |
| WO | 2013/182177 | A1 | 12/2013 |
| WO | 2013/182178 | A1 | 12/2013 |

OTHER PUBLICATIONS

International Search Report of PCT/DE2015/000007, dated Apr. 29, 2015.

International Search Report of PCT/DE2015/000008, dated Apr. 28, 2015.

DIN EN 10090, Valve steels and alloys for internal combustion engines, Mar. 1998, 17 pages.

C. Rynio et al, High temperature wear testing of a Ni-based superalloy pin on a cast iron disc, u. Werkstoffstech. 44 (2013), pp. 825-831.

DIN EN ISO 6892-2, Metallic materials—Tensile testing—Part 2: Method of test at elevated temperature, May 2011, 28 pages.

International Search Report of PCT/DE2013/000268, dated Nov. 6, 2013.

R. T. Holt et al: "Impurities and trace elements in nickel-base superalloys", International Materials Reviews, Review 203, (Mar. 1976), pp. 1-24.

DIN EN ISO 6892-1, Metallic materials—Tensile testing—Part 1: Method of test at room temperature, First edition Aug. 15, 2009.

International Search Report of PCT/DE2013/000269, dated Nov. 11, 2013.

Grabke et al: "Metal dusting of nickel-base alloys", Materials and Corrosion 47, (1996), pp. 495-504.

Hermse et al: "Metal dusting: relationship between alloy composition and degradation rate", Corrosion Engineering, Science and Technology 2009, vol. 44, No. 3, pp. 182-185.

Slevolden et al: Tjeldbergodden Methanol Plant: Metal Dusting Investigations, NACE International Corrosion 2011 Conference & Expo, Paper No. 11144, pp. 1-15 (2011).

Buergel, Handbuch Hochtemperatur-Werkstofftechnik, Vieweg VEriag, Wiesbaden, 2006, pp. 358-374.

INCONEL alloy 690, Oct. 9, 2009, XP055085643, URL:http://www.specialmetals.com/documents/Inconelalloy690.pdf, pp. 1-8.

INCONEL R Alloy 693—Excellent Resistance to Metal Dusting and High Temperature Corrosion, internet citation, Nov. 17, 2004, URL:http://www.specialmetals.com/documents/Inconel%2Oalloy%20693.pdf, pp. 1-8.

Baker et al: 02394, Nickel-Base Material Solutions to Metal Dusting Problems, 2002 NACE Conference papers (NACE International), Jan. 2, 2002, URL:http://www.asminternational.org/portal/site/www/AsmStore/ProductDEtals/?vgnetoid=3c2ee604e3d33210VgnVcM100000701e010aRCR, 16 pages.

Chinese Office Action dated Feb. 5, 2018 in Chinese Application No. 201580002970.8 with English translation.

(56) References Cited

OTHER PUBLICATIONS

Chinese Search Report dated Jan. 23, 2018 in Chinese Application No. 201580002970.8.
"Metallographic Analysis," Compile Group of Metallographic Analysis, Shanghai Jiao Tong University, National Defense Industry Press, p. 477, 1982 with English translation.
Newmann, W. et al, "High temperature corrosion of internal combustion engine valves", Abstract, downloaded Sep. 29, 2020, (3 pages).
VDM Alloy 751, Nicrofer 7016 TiAl, Nov. 2017, (4 pages).
C.H. Allen et al., "Corrosion of Gasoline Engine Exhaust Valve Steels", Corrosion, Technical Section, Abstract, Jan. 1956, (1 page).
Jardine, F., Engine Corrosion—Its Causes and Avoidance 250030, SAE International, Jan. 1, 1925, (3 pages).
Ramesh Venkat, "Resisting metal dusting corrosion", Digital Refining, Jan. 2019, with attached VDM Alloy 699XA Technical Sheet, downloaded Sep. 29, 2020, (3 pages).
Nishiyama et al., Development of Metal Dusting Resistant Alloy for Synthesis Gas Production Plants, Nippon Steel & Sumitomo Metal Technical Report No. 107, Feb. 2015, pp. 65-70 (6 pages).
"Development of Materials Resistant to Metal Dusting Degradation", Argonne National Laboratory, Annual Report for Calendar Year 2005, p. 29 (2 pages).
Davis, J.R., "ASM Specialty Handbook—Nickel, Cobalt, and Their Alloys—2.5 Nickel Powders", ASM International, 2000, pp. 7-13 (8 pages).
B. Geddes et al., "Superalloys: Alloying and Performance—Chapter 5 Compositional Effects", ASM International, 2010, pp. 59-109 (51 pages).

* cited by examiner

HARDENED NICKEL-CHROMIUM-TITANIUM-ALUMINUM ALLOY WITH GOOD WEAR RESISTANCE, CREEP RESISTANCE, CORROSION RESISTANCE AND WORKABILITY

CROSS REFERENCE TO RELATE APPLICATIONS

This application is the National Stage of PCT/DE2015/000009 filed on Jan. 12, 2015, which claims Priority under 35 U.S.C. §119 of German Application No. 10 2014 001 329.4 filed on Feb. 4, 2014, the disclosure of which is incorporated by reference. The international application under PCT article 21(2) was not published in English.

The invention relates to a nickel-chromium-titanium-aluminum wrought alloy with very good wear resistance and at the same time very good high-temperature corrosion resistance, good creep strength and good processability.

Austenitic age-hardening nickel-chromium-titanium-aluminum alloys with different nickel, chromium titanium and aluminum contents have long been used for outlet valves of engines. For this service, a good wear resistance, a good high-temperature strength/creep strength, a good fatigue strength and a good high-temperature corrosion resistance (especially in exhaust gases) are necessary.

For outlet valves, DIN EN 10090 specifies especially the austenitic alloys, among which the nickel alloys 2.4955 and 2.4952 (NiCr20TiAl) have the highest high-temperature strengths and creep rupture stresses of all alloys mentioned in that standard. Table 1 shows the composition of the nickel alloys mentioned in DIN EN 10090, while Tables 2 to 4 show the tensile strengths, the 0.2% offset yield strength and reference values for the creep rupture stress after 1000 h.

Two alloys with high nickel content are mentioned in DIN EN 10090:

a) NiFe25Cr20NbTi with 0.05-0.10% C, max. 1.0% Si, max. 1.0% Mn, max. 0.030% P, max. 0.015% S, 18.00 to 21.00% Cr, 23.00 to 28.00% Fe, 0.30-1.00% Al, 1.00 to 2.00% Ti, 1.00-2.00% Nb+Ta, max. 0.008% B and the rest Ni.

b) NiCr20TiAl with 0.05-0.10% C, max. 1.0% Si, max. 1.0% Mn, max. 0.020% P, max. 0.015% S, 18.00 to 21.00% Cr, max. 3% Fe, 1.00-1.80% Al, 1.80 to 2.70% Ti, max. 0.2% Cu, max. 2.0% Co, max. 0.008% B and the rest Ni.

Compared with NiFe25Cr20NbTi, NiCr20TiAl has significantly higher tensile strengths, 0.2% offset yield strengths and creep rupture stresses at higher temperatures.

EP 0639654 A2 discloses an iron-nickel-chromium alloy consisting (in weight-%) of up to 0.15% C, up to 1.0% Si, up to 3.0% Mn, 30 to 49% Ni, 10 to 18% Cr, 1.6 to 3.0% Al, one or more elements from Group IVa to Va with a total content of 1.5 to 8.0%, the rest Fe and unavoidable impurities, wherein Al is an indispensable additive element and one or more elements from the already mentioned Group IVa to Va must satisfy the following formula in atomic-%:

$$0.45 \leq Al/(Al+Ti+Zr+Hf+V+Nb+Ta) \leq 0.75$$

WO 2008/007190 A2 discloses a wear-resistant alloy consisting (in weight-%) of 0.15 to 0.35% C, up to 1.0% Si, up to 1.0% Mn, >25 to <40% Ni, 15 to 25% Cr, up to 0.5% Mo, up to 0.5% W, >1.6 to 3.5% Al, >1.1% to 3% in the total of Nb+Ta, up to 0.015% B, the rest Fe and unavoidable impurities, wherein Mo+0.5 W is ≤0.75%; Ti+Nb is ≥4.5% and 13≤(Ti+Nb)/C≤50. The alloy is particularly useful for the manufacture of outlet valves for internal-combustion engines. The good wear resistance of this alloy results from the high proportion of primary carbides that are formed on the basis of the high carbon content. However, a high proportion of primary carbides causes processing problems during the manufacture of this alloy as a wrought alloy.

For all mentioned alloys, the high-temperature strength or creep strength in the range of 500° C. to 900° C. is due to the additions of aluminum, titanium and/or niobium (or further elements such as Ta, etc.), which lead to precipitation of the γ' and/or γ" phase. Furthermore, the high-temperature strength or the creep strength is also improved by high contents of solid-solution-hardening elements such as chromium, aluminum, silicon, molybdenum and tungsten, as well as by a high carbon content.

Concerning the high-temperature corrosion resistance, it must be pointed out that alloys with a chromium content of around 20% form a chromium oxide layer ($Cr_2O_3$) that protects the material. In the course of service in the area of application, the chromium content is slowly consumed for buildup of the protective layer. Therefore the useful life of the material is improved by a higher chromium content, since a higher content of the element chromium forming the protective layer delays the point in time at which the Cr content falls below the critical limit and oxides other than $Cr_2O_3$ are formed, such as cobalt-containing and nickel-containing oxides, for example.

For processing of the alloy, especially during hot forming, it is necessary that no phases that greatly strain-harden the material, such as the γ' or γ" phase, for example, are formed at temperatures at which hot forming takes place, and thus lead to cracking during hot forming. At the same time, these temperatures must be sufficiently far below the solidus temperature of the alloy to prevent incipient melting in the alloy.

The task underlying the invention consists in conceiving a nickel-chromium wrought alloy that has

- a better wear resistance than NiCr20TiAl
- a better corrosion resistance than NiCr20TiAl
- a good high-temperature strength/creep strength similar to that of NiCr20TiAl
- a good processability similar to that of NiCr20TiAl.

This task is accomplished by an age-hardening nickel-chromium-titanium-aluminum wrought alloy with very good wear resistance and at the same time very good high-temperature corrosion resistance, good creep strength and good processability, with (in mass-%) 25 to 35% chromium, 1.0 to 3.0% titanium, 0.6 to 2.0% aluminum, 0.005 to 0.10% carbon, 0.0005 to 0.050% nitrogen, 0.0005 to 0.030% phosphorus, max. 0.010% sulfur, max. 0.020% oxygen, max. 0.70% silicon, max. 2.0% manganese, max. 0.05% magnesium, max. 0.05% calcium, max. 2.0% molybdenum, max. 2.0% tungsten, max. 0.5% niobium, max. 0.5% copper, max. 0.5% vanadium, if necessary 0 to 20% Fe, if necessary 0 to 15% cobalt, if necessary 0 to 0.20% Zr, if necessary 0.0001 to 0.008% boron, the rest nickel and the usual process-related impurities, wherein the nickel content is greater than 35% and the following relationships must be satisfied:

$$Cr+Fe+Co \geq 26\% \quad (1)$$

in order to achieve good processability and $$fh \geq 0 \text{ with} \quad (2a)$$

$$fh = 6.49+3.88Ti+1.36Al-0.301Fe+(0.759-0.0209Co)Co-0.428Cr-28.2C \quad (2)$$

in order that an adequate strength is achieved at higher temperatures, wherein Ti, Al, Fe, Co, Cr and C are the concentrations of the elements in question in mass-% and fh is expressed in %.

Advantageous improvements of the subject matter of the invention can be inferred from the associated dependent claims.

The variation range for the element chromium lies between 25 and 35%, wherein preferred ranges may be adjusted as follows:

26 to 35%
27 to 35%
28 to 35%
28 to 35%
28 to 32%
28 to 30%

The titanium content lies between 1.0 and 3.0%. Preferably Ti may be adjusted within the variation range as follows in the alloy:

1.5-3.0%,
1.8-3.0%,
2.0-3.0%,
2.2-3.0%
2.2-2.8%.

The aluminum content lies between 0.6 and 2.0%, wherein here also, depending on service range of the alloy, preferred aluminum contents may be adjusted as follows:

0.9 to 2.0%
1.0 to 2.0%
1.2 to 2.0%

The alloy contains 0.005 to 0.10% carbon. Preferably this may be adjusted within the variation range as follows in the alloy:

0.01-0.10%.
0.02-0.10%.
0.04-0.10%.
0.04-0.08%

This is similarly true for the element nitrogen, which is contained in contents between 0.0005 and 0.05%. Preferred contents may be specified as follows:

0.001-0.05%.
0.001-0.04%.
0.001-0.03%.
0.001-0.02%.
0.001-0.01%.

The alloy further contains phosphorus in contents between 0.0005 and 0.030%. Preferred contents may be specified as follows:

0.001-0.030%.
0.001-0.020%.

The element sulfur is specified as follows in the alloy:

Sulfur max. 0.010%

The element oxygen is contained in the alloy in contents of max. 0.020%. Preferred further contents may be specified as follows:

max. 0.010%.
max. 0.008%.
max. 0.004%

The element Si is contained in the alloy in contents of max. 0.70%. Preferred further contents may be specified as follows:

max. 0.50%
max. 0.20%
max. 0.10%

Furthermore, the element Mn is contained in the alloy in contents of max. 2.0%. Preferred further contents may be specified as follows:

max. 0.60%
max. 0.20%
max. 0.10%

The element Mg is contained in the alloy in contents of max. 0.05%. Preferred further contents may be specified as follows:

max. 0.04%.
max. 0.03%.
max. 0.02%.
max. 0.01%.

The element Ca is contained in the alloy in contents of max. 0.05%. Preferred further contents may be specified as follows:

max. 0.04%.
max. 0.03%.
max. 0.02%.
max. 0.01%.

The element niobium is contained in the alloy in contents of max. 0.5%. Preferred further contents may be specified as follows:

max. 0.20%
max. 0.10%
max. 0.05%
max. 0.02%

Molybdenum and tungsten are contained individually or in combination in the alloy with a content of maximum 2.0% each. Preferred contents may be specified as follows:

Mo max. 1.0%
W max. 1.0.
Mo≤0.50%
W≤0.50%
Mo≤0.10%
W≤0.10%
Mo≤0.05%
W≤0.05%

Furthermore, maximum 0.5% Cu may be contained in the alloy.

Beyond this, the content of copper may be limited as follows:

Cu≤0.10.
Cu≤0.05%
Cu≤0.015%

Furthermore, maximum 0.5% vanadium may be contained in the alloy.

Furthermore, the alloy may if necessary contain between 0.0 and 20.0% iron, which beyond this may be limited even more as follows:

>0 to 15.0%
>0 to 12.0%
>0 to 9.0%
>0 to 6.0%
>0 to 3.0%
1.0 to 20.0%
1.0 to 15.0%
1.0 to 12.0%
1.0 to 9.0%
1.0 to 6.0%
>3.0 to 20.0%
>3.0 to 15.0%
>3.0 to 12.0%
>3.0 to 9.0%
>3.0 to 6.0%

Furthermore, the alloy may if necessary contain between 0.0 and 15% cobalt, wherein, depending on the area of application, preferred contents may be adjusted within the following variation ranges:

>0-12%
>0-10%
>0-8%
>0-7%
>0-<5%
0.20-20%
0.20-12%
0.20-10%
0.20-<5%
2.0-20%
2.0-12%
2.0-10%
2-<5%

Furthermore, the alloy may if necessary contain between 0 and 0.20% zirconium, which beyond this may be limited even more as follows:

0.01-0.20%.
0.01-0.15%.
0.01-<0.10%.

Furthermore, between 0.0001 and 0.008% boron may if necessary be contained in the alloy as follows. Preferred further contents may be specified as follows:

0.0005-0.006%
0.0005-0.004%

The nickel content should be higher than 35%. We may specify preferred further contents as follows:

>40%.
>45%.
>50%.
>55%.

The following relationship between Cr and Fe and Co must be satisfied in order to ensure an adequate resistance to wear:

$$Cr+Fe+Co \geq 26\% \quad (1)$$

wherein Cr, Fe and Co are the concentrations of the elements in question in mass-%.

Preferred further ranges may be adjusted with $$Cr+Fe+Co \geq 27\% \quad (1a)$$

$$Cr+Fe+Co \geq 28\% \quad (1b)$$

$$Cr+Fe+Co \geq 29\% \quad (1c)$$

The following relationship between Ti, Al, Fe, Co, Cr and C must be satisfied in order that an adequately high strength at higher temperatures is achieved:

$$fh \geq 0 \text{ with} \quad (2a)$$

$$fh=6.49+3.88Ti+1.36Al-0.301Fe+(0.759-0.0209Co)Co-0.428Cr-28.2C \quad (2)$$

wherein Ti, Al, Fe, Co, Cr and C are the concentrations of the elements in question in mass-% and fh is expressed in %.

Preferred ranges may be adjusted with $$fh \geq 1\% \quad (2b)$$

$$fh \geq 3\% \quad (2c)$$

$$fh \geq 4\% \quad (2d)$$

$$fh \geq 5\% \quad (2e)$$

$$fh \geq 6\% \quad (2f)$$

$$fh \geq 7\% \quad (2f)$$

Optionally the following relationship between Cr, Mo, W, Fe, Co, Ti, Al and Nb may be satisfied in the alloy, in order that adequately good processability is achieved:

$$fver \leq 7 \text{ with} \quad (3a)$$

$$fver=32.77+0.5932Cr+0.3642Mo+0.513W+(0.3123-0.0076Fe)Fe+(0.3351-0.003745Co-0.0109Fe)Co+40.67Ti*Al+33.28Al^2-13.6TiAl^2-22.99Ti-92.7Al+2.94Nb \quad (3)$$

wherein Cr, Mo, W, Fe, Co, Ti, Al and Nb are the concentrations of the elements in question in mass-% and fver is expressed in %. Preferred ranges may be adjusted with $$fver \leq 5\% \quad (3b)$$

$$fver \leq 3\% \quad (3c)$$

$$fver < 0\% \quad (3d)$$

Optionally the element yttrium may be adjusted in contents of 0.0 to 0.20% in the alloy. Preferably Y may be adjusted within the variation range as follows in the alloy:

0.01-0.20%
0.01-0.15%
0.01-0.10%
0.01-0.08%
0.01-<0.045%.

Optionally the element lanthanum may be adjusted in contents of 0.0 to 0.20% in the alloy. Preferably La may be adjusted within the variation range as follows in the alloy:

0.001-0.20%
0.001-0.15%
0.001-0.10%
0.001-0.08%
0.001-0.04%.
0.01-0.04%.

Optionally the element Ce may be adjusted in contents of 0.0 to 0.20% in the alloy. Preferably Ce may be adjusted within the variation range as follows in the alloy:

0.001-0.20%
0.001-0.15%
0.001-0.10%
0.001-0.08%
0.001-0.04%
0.01-0.04%.

Optionally, in the case of simultaneous addition of Ce and La, cerium mixed metal may also be used in contents of 0.0 to 0.20%. Preferably cerium mixed metal may be adjusted within the variation range as follows in the alloy:

0.001-0.20%
0.001-0.15%
0.001-0.10%
0.001-0.08%
0.001-0.04%.
0.01-0.04%.

Optionally 0.0 to 0.20% hafnium may also be contained in the alloy. Preferred ranges may be specified as follows:

0.001-0.20%.
0.001-0.15%
0.001-0.10%
0.001-0.08%
0.001-0.04%
0.01-0.04%.

Optionally 0.0 to 0.60% tantalum may also be contained in the alloy 0.001-0.60%.
0.001-0.40%.
0.001-0.20%.

0.001-0.15%
0.001-0.10%
0.001-0.08%
0.001-0.04%
0.01-0.04%.

Finally, the elements lead, zinc and tin may also be present as impurities in the following contents:

Pb max. 0.002%
Zn max. 0.002%
Sn max. 0.002%.

The alloy according to the invention is preferably melted in the vacuum induction furnace (VIM), but may also be melted under open conditions, followed by a treatment in a VOD or VLF system. After casting in ingots or possibly as continuous casting, the alloy is annealed if necessary at temperatures between 600° C. and 1100° C. for 0.1 to 100 hours, if necessary under protective gas such as argon or hydrogen, for example, followed by cooling in air or in the moving annealing atmosphere. Thereafter remelting may be carried out by means of VAR or ESR, if necessary followed by a 2nd remelting process by means of VAR or ESR. Then the ingots are annealed if necessary at temperatures between 900° C. and 1270° C. for 0.1 to 70 hours, then hot-formed, if necessary with one or more intermediate annealings between 900° C. and 1270° C. for 0.05 to 70 hours. The hot forming may be carried out, for example, by means of forging or hot rolling. Throughout the entire process, the surface of the material may if necessary be machined (even several times) intermediately and/or at the end chemically (e.g. by pickling) and/or mechanically (e.g. by cutting, by abrasive blasting or by grinding) in order to clean it. The control of the hot-forming process may be applied such that thereafter the semifinished product is already recrystallized with grain sizes between 5 and 100 μm, preferably between 5 and 40 μm. If necessary, solution annealing is then carried out in the temperature range of 700° C. to 1270° C. for 0.1 min to 70 hours, if necessary under protective gas such as argon or hydrogen, for example, followed by cooling in air, in the moving annealing atmosphere or in the water bath. After the end of hot forming, cold forming to the desired semifinished product form may be carried out if necessary (for example by rolling, drawing, hammering, stamping, pressing) with reduction ratios up to 98%, if necessary with intermediate annealings between 700° C. and 1270° C. for 0.1 min to 70 hours, if necessary under protective gas such as argon or hydrogen, for example, followed by cooling in air, in the moving annealing atmosphere or in the water bath. If necessary, chemical and/or mechanical (e.g. abrasive blasting, grinding, turning, scraping, brushing) cleanings of the material surface can be carried out intermediately in the cold-forming process and/or after the last annealing.

The alloys according to the invention or the finished parts made therefrom attain the final properties by age-hardening annealing between 600° C. and 900° C. for 0.1 to 300 hours, followed by cooling in air and/or in a furnace. By such an age-hardening annealing, the alloy according to the invention is age-hardened by precipitation of a finely dispersed γ' phase. Alternatively, a two-stage annealing may also be carried out, wherein the first annealing takes place in the range of 800° C. to 900° C. for 0.1 to 300 hours, followed by cooling in air and/or furnace, and a second annealing takes place between 600° C. and 800° C. for 0.1 hours to 300 hours, followed by cooling in air.

The alloy according to the invention can be readily manufactured and used in the product forms of strip, sheet, rod, wire, longitudinally welded pipe and seamless pipe.

These product forms are manufactured with a mean grain size of 3 μm to 600 μm. The preferred range lies between 5 pμm and 70 μm, especially between 5 and 40 μm.

The alloy according to the invention can be readily processed by means of forging, upsetting, hot extrusion, hot rolling and similar processes. By means of these methods it is possible to manufacture components such as valves, hollow valves or bolts, among others.

It is intended that the alloy according to the invention will be used preferably in areas for valves, especially outlet valves of internal combustion engines. However, use in components of gas turbines, as fastening bolts, in springs and in turbochargers is also possible.

The parts manufactured from the alloy according to the invention, especially the valves or the valve seat faces, for example, may be subjected to further surface treatments, such a nitriding, for example, in order to increase the wear resistance further.

Tests Carried Out:

For measurement of the wear resistance, oscillating dry sliding wear tests were carried out in a pin-on-disk test bench (Optimol SRV IV tribometer). The radius of the hemispherical pins, which were polished to a mirror finish, was 5 mm. The pins were made from the material to be tested. The disk consisted of cast iron with a tempered, martensitic matrix with secondary carbides within a eutectic carbide network with the composition (C≈1.5%, Cr≈6%, S≈0.1%, Mn≈1%, Mo≈9%, Si≈1.5%, V≈3%, the rest Fe). The tests were carried out at a load of 20 N with a sliding path of one mm, a frequency of 20 Hz and a relative humidity of approximately 45% at various temperatures. Details of the tribometer and of the test procedure are described in C. Rynio, H. Hattendorf, J. Klöwer, H.-G. Lüdecke, G. Eggeler, Mat.-wiss. u. Werkstofftech. 44 (2013), 825. During the tests, the coefficient of friction, the linear displacement of the pin in disk direction (as a measure of the linear total wear of pin and disk) and the electrical contact resistance between pin and disk are continuously measured. Two different load-sensing modules, which are denoted in the following by (a) and (n), were used for the measurements. They yield results that are quantitatively slightly different but qualitatively similar. The load-sensing module (n) is the more accurate. After the end of a test, the volume loss of the pin was determined and used as a measure of the ranking for the wear resistance of the material of the pin.

The high-temperature strength was determined in a hot tension test according to DIN EN ISO 6892-2. For this purpose the offset yield strength $R_{p0.2}$ and the tensile strength $R_m$ were determined. The tests were performed on round specimens with a diameter of 6 mm in the measurement area and an initial gauge length $L_0$ of 30 mm. The specimens were taken transverse to the forming direction of the semifinished product. The crosshead speed for $R_{p0.2}$ was $8.33 \cdot 10^{-5}$ l/s (0.5%/min) and for $R_m$ was $8.33 \cdot 10^{-4}$ l/s (5%/min).

The specimen was mounted at room temperature in a tension testing machine and heated to the desired temperature without being loaded with a tensile force. After the test temperature was reached, the specimen was maintained without load for one hour (600° C.) or two hours (700° C. to 1100° C.) for temperature equilibration. Thereafter the specimen was loaded with a tensile force such that the desired elongation rates were maintained and the test was begun.

The creep strength of a material is improved with increasing high-temperature strength. Therefore the high-temperature strength is also used for appraisal of the creep strength of the various materials.

The corrosion resistance at higher temperatures was determined in an oxidation test at 800° C. in air, wherein the test was interrupted every 96 hours and the changes in mass of the specimens due to the oxidation were determined. The specimens were confined in ceramic crucibles during the test, so that any oxide spalling off was collected, allowing the mass of spalled oxide to be determined by weighing the crucible containing the oxide. The sum of the mass of the spalled oxide and of the change in mass of the specimen is the gross change in mass of the specimen. The specific change in mass is the change in mass relative to the surface area of the specimens. In the following, these are denoted by $m_{net}$ for the specific net change in mass, $m_{gross}$ for the specific gross change in mass and $m_{spall}$ for the specific change in mass of the spalled oxides. The tests were carried out on specimens with a thickness of approximately 5 mm. Three specimens were removed from each batch; the reported values are the mean values of these 3 specimens.

The phases occurring at equilibrium were calculated for the various alloy variants with the JMatPro program of Thermotech. The TTNI7 database for nickel-base alloys of Thermotech was used as the database for the calculations. In this way it is possible to identify phases that if formed embrittle the material in the service range. Furthermore, it is possible to identify the temperature ranges in which, for example, hot forming should not be carried out, since under those conditions phases form that greatly strain-harden the material and thus lead to cracking during hot forming. For a good processability, especially for hot forming, such as hot rolling, forging, upsetting, hot extrusion and similar processes, for example, an adequately broad temperature range in which such phases are not formed must be available.

Description of the Properties

In accordance with the stated task, the alloy according to the invention should have the following properties:

- a better wear resistance compared with NiCr20TiAl
- a better corrosion resistance compared with NiCr20TiAl
- a good high-temperature strength/creep strength similar to that of NiCr20TiAl
- a good processability similar to that of NiCr20TiAl.

Wear Resistance

The new alloy should have a better wear resistance than the NiCr20TiAl reference alloy. Besides this material, Stellite 6 was also tested for comparison. Stellite 6 is a highly wear-resistant cobalt-base cast alloy with a network of tungsten carbides, consisting of approximately 28% Cr, 1% Si, 2% Fe, 6% W, 1.2% C, the rest Co, but because of its high carbide content it must be cast directly into the desired shape. By virtue of its network of tungsten carbides, Stellite 6 attains a very high hardness of 438 HV30, which is very advantageous for the wear. The alloy "E" according to the invention is supposed to approach the volume loss of Stellite 6 as closely as possible. The objective is in particular to decrease the high-temperature wear between 600 and 800° C., which is the relevant temperature range for application as an outlet valve, for example. Therefore the following criteria in particular should apply for the alloys "E" according to the invention:

$$\text{Mean value of the volume loss (alloy "E")} \leq 0.50 \times \text{mean value of the volume loss (NiCr20TiAl reference) at 600° C. or 800° C.} \quad (4a)$$

In the "low-temperature range" of the wear, the volume loss is not permitted to increase disproportionately. Therefore the following criteria should be additionally applicable.

$$\text{Mean value of the volume loss (alloy "E")} \leq 1.30 \times \text{mean value of the volume loss (NiCr20TiAl reference) at 25° C. and 300° C.} \quad (4b)$$

If a volume loss of NiCr20TiAl both for an industrial-scale batch and a reference laboratory batch is available in a series of measurements, the mean value of these two batches must be used in the inequalities (4a) and (4b).

High-Temperature Strength/Creep Strength

Table 3 shows the lower end of the scatter band of the 0.2% offset yield strength for NiCr20TiAl in the age-hardened state at temperatures between 500 and 800° C., while Table 2 shows the lower end of the scatter band of the tensile strength.

The 0.2% offset yield strength of the alloy according to the invention should lie at least in this value range for 600° C. and should not be more than 50 MPa smaller than this value range for 800° C., in order to obtain adequate strength. This means in particular that the following values should be attained:

$$600° \text{ C.: Offset yield strength } R_{p0.2} \geq 650 \text{ MPa} \quad (5a)$$

$$800° \text{ C.: Offset yield strength } R_{p0.2} \geq 390 \text{ MPa} \quad (5b)$$

The inequalities (5a) and (5b) are attained in particular when the following relationship between Ti, Al, Fe, Co, Cr and C is satisfied:

$$fh \geq 0 \text{ with} \quad (2a)$$

$$fh = 6.49 + 3.88\text{Ti} + 1.36\text{Al} - 0.301\text{Fe} + (0.759 - 0.0209\text{Co})\text{Co} - 0.428\text{Cr} - 28.2\text{C} \quad (2)$$

wherein Ti, Al, Fe, Co, Cr and C are the concentrations of the elements in question in mass-% and fh is expressed in %.

Corrosion Resistance

The alloy according to the invention should have a corrosion resistance in air similar to that of NiCr20TiAl.

Processability

For nickel-chromium-iron-titanium-aluminum alloys, the high-temperature strength or creep strength in the range of 500° C. to 900° C. depends on the additions of aluminum, titanium and/or niobium, which lead to precipitation of the γ' and/or γ" phase. If the hot forming of these alloys is carried out in the precipitation range of these phases, the risk of cracking exists. Thus the hot forming should preferably take place above the solvus temperature $T_{s\gamma'}$ (or $T_{s\gamma''}$) of these phases. To ensure that an adequate temperature range is available for the hot forming, the solvus temperature $T_{s\gamma'}$ (or $T_{s\gamma''}$) should be below 1020° C.

This is satisfied in particular when the following relationship between Cr, Mo, W, Fe, Co, Ti, Al and Nb is satisfied:

$$fver = \leq 7 \text{ with} \quad (3a)$$

$$fver = 32.77 + 0.5932\text{Cr} + 0.3642\text{Mo} + 0.513\text{W} + (0.3123 - 0.0076\text{Fe})\text{Fe} + (0.3351 - 0.003745\text{Co} - 0.0109\text{Fe})\text{Co} + 40.67\text{Ti}*\text{Al} + 33.28\text{Al}^2 - 13.6\text{TiAl}^2 - 22.99\text{Ti} - 92.7\text{Al} + 2.94\text{Nb} \quad (3)$$

wherein Cr, Mo, W, Fe, Co, Ti, Al and Nb are the concentrations of the elements in question in mass-% and fver is expressed in %.

EXAMPLES

Manufacture

Tables 5a and 5b show the analyses of the batches melted on the laboratory scale together with some industrial-scale batches melted according to the prior art (NiCr20TiAl) and cited for reference. The batches according to the prior art are marked with a T, and those according to the invention with an E. The batches melted on the laboratory scale are marked with an L and the batches melted on the industrial scale with a G. Batch 250212 is NiCr20TiAl, but was melted at a laboratory batch and is used as reference.

The ingots of the alloys in Tables 5a and b melted on the laboratory scale in vacuum were annealed between 1100° C. and 125° C. for 0.1 to 70 hours and hot-rolled to a final thickness of 13 mm and 6 mm respectively by means of hot rolling and further intermediate annealings between 1100° C. and 1250° C. for 0.1 to 1 hour. The temperature control during hot rolling was such that the sheets were recrystallized. The specimens needed for the measurements were prepared from these sheets.

The comparison batches melted on an industrial scale were melted by means of VIM and cast as ingots. These ingots were remelted by ESR. These ingots were annealed between 1100° C. and 1250° C. for 0.1 min to 70 h, if necessary under protective gas such as argon or hydrogen, for example, followed by cooling in air, in the moving annealing atmosphere or in the water bath, and hot-rolled to a final diameter between 17 and 40 mm by means of hot rolling and further intermediate annealings between 1100° C. and 1250° C. for 0.1 to 20 hours. The temperature control during hot rolling was such that the sheets were recrystallized.

All alloy variants typically had a grain size of 21 to 52 μm (see Table 6).

After preparation of the specimens, these were age-hardened by an annealing at 850° C. for 4 hours/cooling in air followed by an annealing at 700° C. for 16 hours/cooling in air:

Table 6 shows the Vickers hardness HV30 before and after the age-hardening annealing. The hardness HV30 in the age-hardened state is in the range of 366 to 416 for all alloys except for batch 250330. Batch 250330 had a somewhat lower hardness of 346 HV30.

For the exemplary batches in Table 5a and 5b, the following properties are compared:

The wear resistance by means of a sliding wear test

The corrosion resistance by means of an oxidation test

The high-temperature strength/creep strength by means of hot tension tests

The processability with phase calculations

Wear Resistance

Wear tests were carried out at 25° C., 300° C., 600° C. and 800° C. on alloys according to the prior art and on the various laboratory heats. Most tests were repeated several times. Mean values and standard deviations were then determined.

The mean values±standard deviations of the measurements carried out are presented in Table 7. In the case of a single value, the standard deviation is missing. For orientation, the composition of the batches is roughly described in the alloy column of Table 7. In addition, the maximum values for the volume loss of the alloys according to the invention, from the inequalities (4a) for 600 and 800° C. respectively and (4b) for 25° C. and 300° C., are entered in the last row.

FIG. 1 shows the volume loss of the pin of NiCr20TiAl batch 320776 according to the prior art as a function of the test temperature, measured with 20 N, sliding path 1 mm, 20 Hz and with the load-sensing module (a). The tests at 25 and 300° C. were carried out for one hour and the tests at 600 and 800° C. were carried out for 10 hours. The volume loss decreases strongly with temperature up to 600° C., i.e. the wear resistance is markedly improved at higher temperatures. In the high-temperature range at 600 and 800° C., a comparatively smaller volume loss and thus a smaller wear is apparent, which is due to the formation of a so-called "glaze" layer between pin and disk. This "glaze" layer consists of compacted metal oxides and material of pin and disk. The higher volume loss at 25° C. and 300° C. even though the time was shorter by the factor 10 shows that the "glaze" layer cannot be completely formed at these temperatures. At 800° C. the volume loss begins to increase slightly again because of the increased oxidation.

Figure 2:
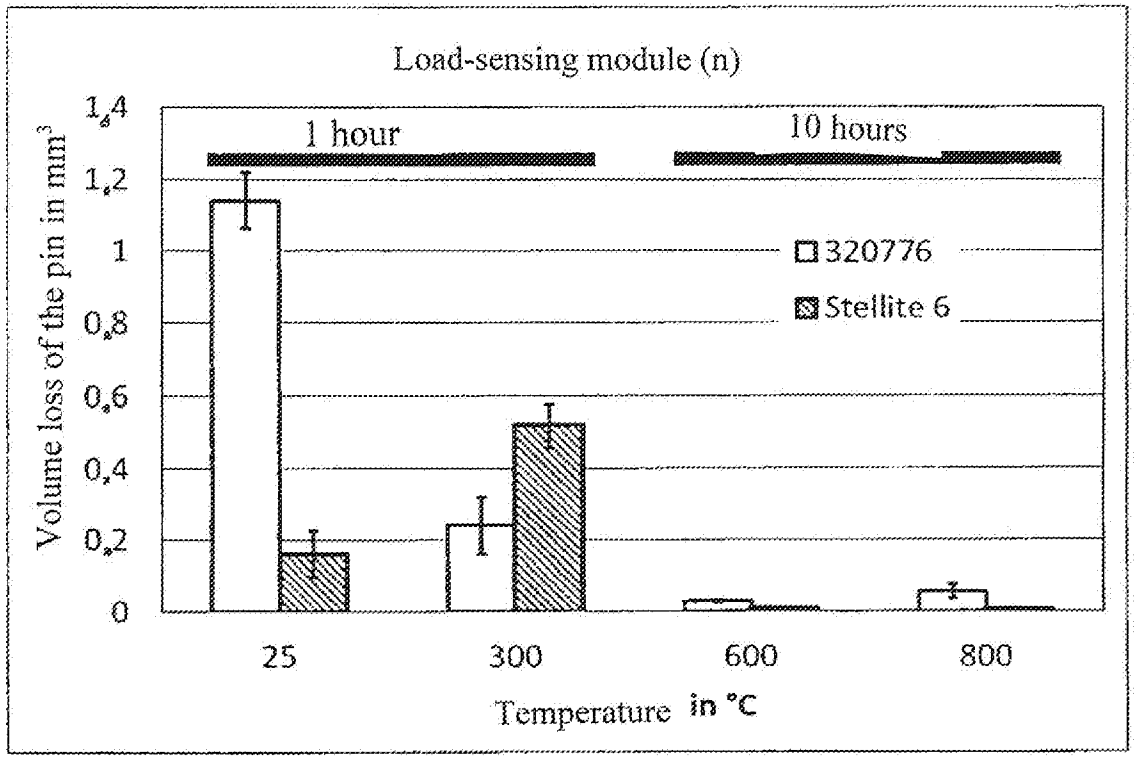

FIG. 2 shows the volume loss of the pin of NiCr20TiAl batch 320776 according to the prior art as a function of the test temperature, measured with 20 N, sliding path 1 mm, 20 Hz and with the load-sensing module (n). For NiCr20TiAl, batch 320776, qualitatively the same behavior as with the load module (a) is observed: The volume loss decreases strongly with temperature up to 600° C., but the values at 600 and 800° C. are even smaller than those measured with the load-sensing module (a). In addition, the values measured on Stellite 6 are also plotted in FIG. 2. Stellite 6 exhibits a better wear resistance (=smaller volume loss) than the NiCr20TiAl comparison alloy, batch 320776 at all temperatures except 300° C.

The volume losses at 600 and 800° C. are very small, and so the differences between various alloys can no longer be measured with certainty. Therefore a test was also carried out at 800° C. with 20 N for 2 hours+100 N for 5 hours, sliding path 1 mm, 20 Hz with load-sensing module (n), in order to cause a somewhat larger wear in the high-temperature range also. The results are plotted in FIG. 3 together with the volume losses measured with 20 N, sliding path 1 mm, 20 Hz and load-sensing module (n) at various temperatures. In this way the volume loss in the high-temperature range of the wear was significantly increased.

The comparison of the various alloys was performed at various temperatures. In FIGS. 4 to 8, the laboratory batches are marked by an L. The most important change compared with the industrial-scale batch 320776 is indicated in the figures with element and rounded value in addition to the laboratory batch number. The exact values are presented in Tables 5a and 5b. The rounded values are used in the text.

Figure 4:
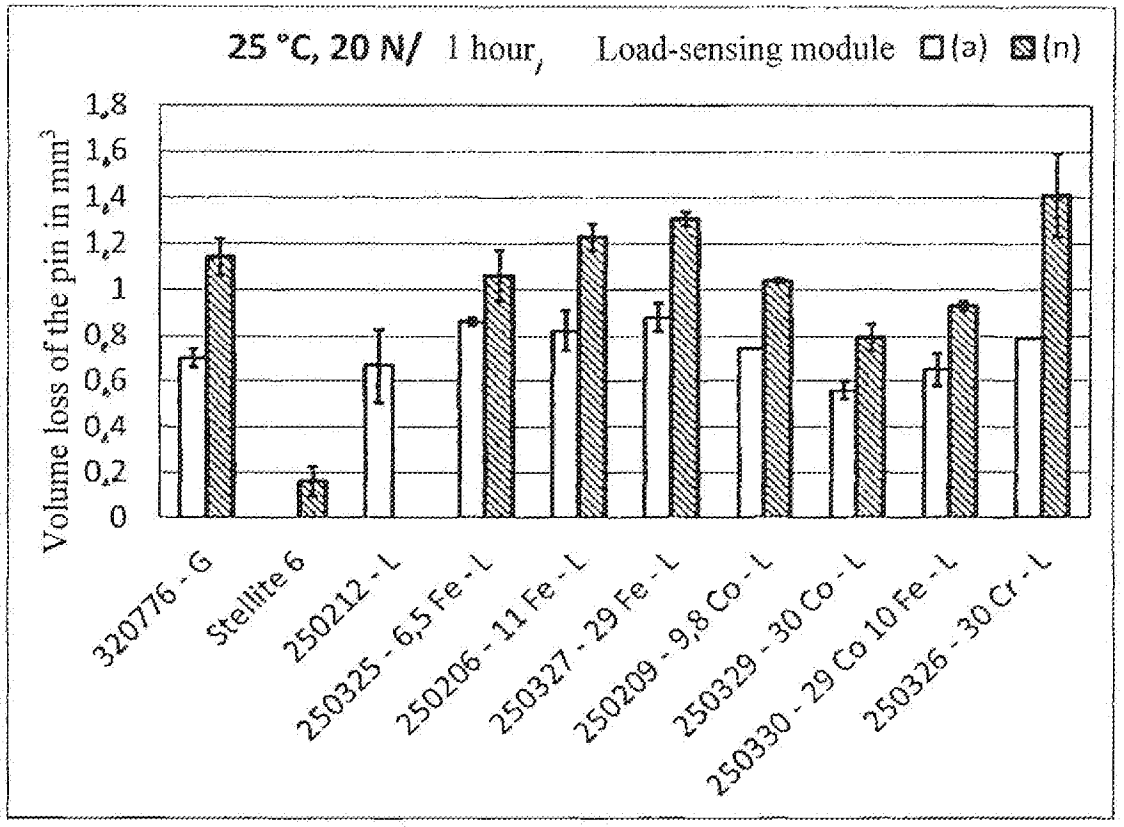

FIG. 4 shows the volume loss of the pin for various laboratory batches in comparison with NiCr20TiAl, batch 320776 and Stellite 6 at 25° C. after 1 hour, measured with 20 N, sliding path 1 mm, 20 Hz with load-sensing module (a) and (n). The values with load-sensing module (n) were systematically smaller than those with load-sensing module (a). Taking this into consideration, it can be recognized that NiCr20TiAl as laboratory batch 250212 and as industrial-scale batch 320776 had similar volume losses within the measurement accuracy. Thus the laboratory batches can be compared directly with the industrial-scale batches in terms of the wear measurements. The batch 250325 containing approximately 6.5% Fe exhibited a volume loss at 25° C. that was smaller than the maximum value from (4b) for both load-sensing modules (see Table 7). The volume loss of batch 250206 containing 11% Fe tended to be in the upper scatter range of batch 320776, but the mean value was also smaller than the maximum value from (4a). Batch 250327 containing 29% Fe exhibited a slightly increased volume loss in the measurements with load-sensing module (n), but the mean value here was also smaller than the maximum value from (4b) for both load-sensing modules. In contrast, the Co-containing laboratory batches tended to exhibit a smaller volume loss, which at 1.04±0.01 $mm^3$ in the case of Batch 250209 (9.8% Co) and load-sensing module (n) is just outside the scatter range of batch 320776. In the case of batch 250229 (30% Co), even a significant decrease of the volume loss to 0.79±0.06 $mm^3$ was then observed, but then it increased slightly again to 0.93±0.02 $mm^3$ in batch 250330 due to the addition of 10% Fe. The increase of the Cr content to 30% in batch 250326 according to the invention compared with the 20% in batch 320776 caused an increase of the volume wear to 1.41±0.18 $mm^3$ (load-sensing module (n)), but this was also below the maximum value from (4a). The inequality (4a) was satisfied for the measurements with both load-sensing modules.

Figure 5:
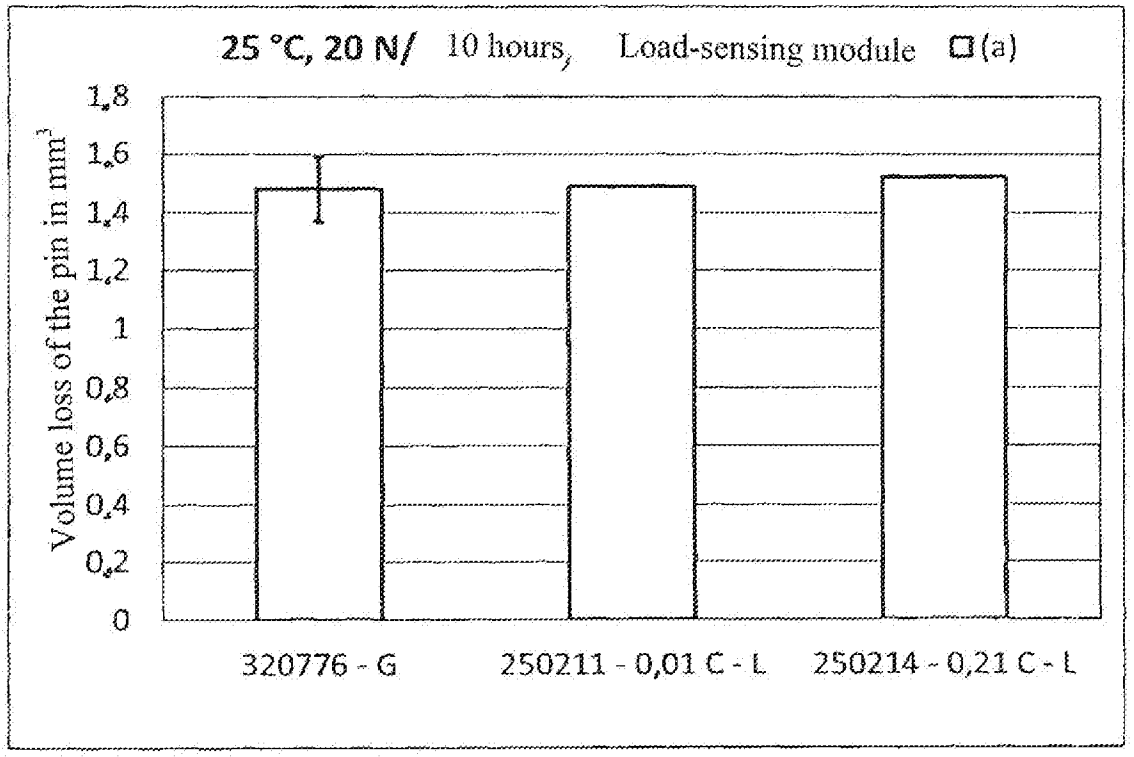

FIG. 5 shows the volume loss of the pin for alloys with different carbon contents in comparison with NiCr20TiAl, batch 320776 at 25° C., measured with 20 N, sliding path 1 mm, 20 Hz with load-sensing module (a) after 10 hours. A change of the volume loss in comparison with batch 320776 was not apparent either due to a decrease of the carbon content to 0.01% in batch 250211 or else to an increase to 0.211% in batch 250214.

FIG. 6 shows the volume loss of the pin for various alloys in comparison with NiCr20TiAl, batch 320776 at 300° C., measured with load-sensing modules (a) and (n), with 20 N, sliding path 1 mm, 20 Hz after 1 hour. The values with load-sensing module (n) are systematically smaller than those with load-sensing module (a). Taking this into consideration in the following, it can be recognized that Stellite 6 was poorer than batch 320776 at 300° C. In the case of the Co-containing laboratory heats 250329 and 250330, no decrease of the wear volume as at room temperature was observed, but instead this was in the range of the wear volume of NiCr20TiAl, batch 320776, and so it did not exhibit any increase as in the case of Stellite 6. The volume loss of all 3 Co-containing batches according to the invention, 250209, 250329 and 250330, was significantly below the maximum value from criterion (4b). In contrast to the behavior at room temperature, the Fe-containing laboratory heats 250206 and 250327 exhibited, with increasing Fe content, a decreasing volume loss, which was therefore below the maximum value (4b). The laboratory batch 250326 according to the invention with the Cr content of 30% had a volume loss in the range of the NiCr20TiAl batch 320776, which was therefore below the maximum value (4b).

Figure 7:
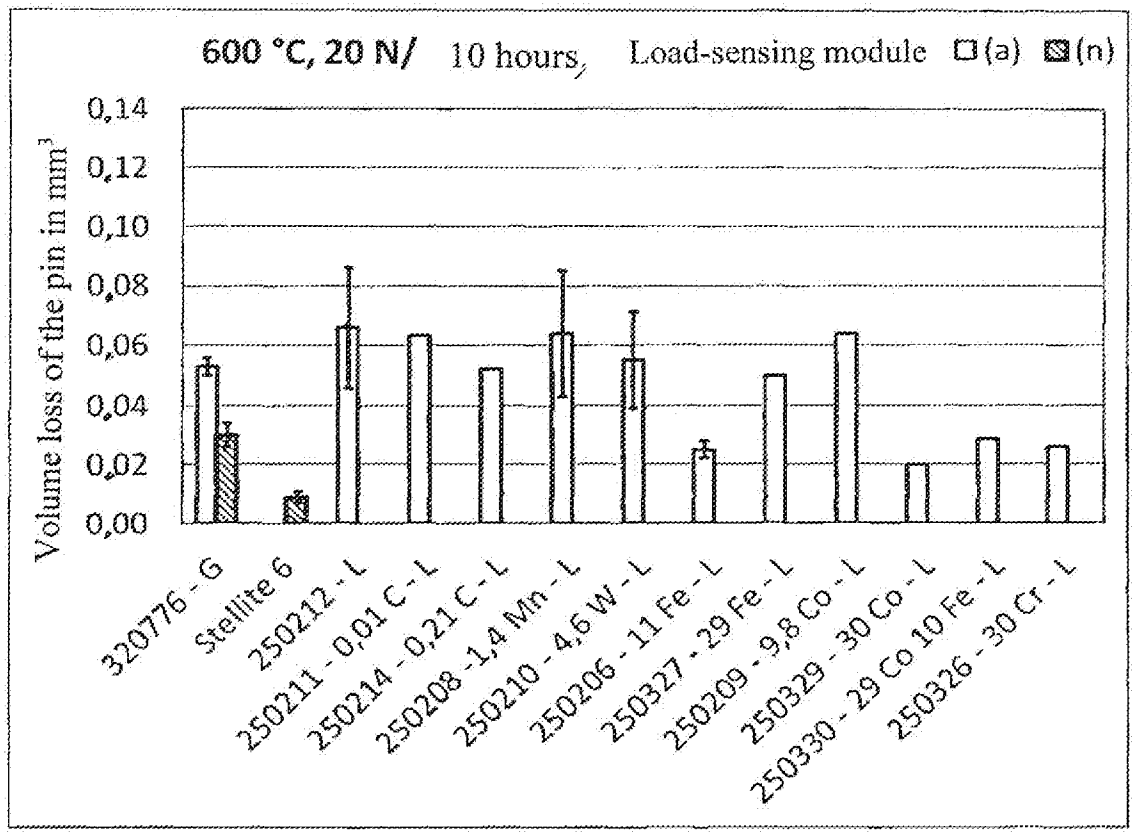

FIG. 7 shows the volume loss of the pin for various alloys in comparison with NiCr20TiAl, batch 320776 at 600° C., measured with 20 N, sliding path 1 mm, 20 Hz and with load-sensing modules (a) and (n) after 10 hours. The values with load-sensing module (n) were systematically smaller than those with load-sensing module (a). It is evident that, in the high-temperature range of the wear also, the reference laboratory batch 250212 of NiCr20TiAl, with 0.066±0.02 $mm^3$, had a volume loss comparable with that of the industrial-scale batch 320776, with 0.053±0.0028 $mm^3$. Thus the laboratory batches can be compared directly with the industrial-scale batches in terms of wear measurements in this temperature range also. Stellite 6 exhibited a volume loss of 0.009±0.002 $mm^3$ (load-sensing module (n)), which is smaller by a factor of 3. Furthermore, it was found that a change of the volume loss in comparison with batch 320776 and 250212 could not be achieved either by a decrease of the carbon content to 0.01% in batch 250211 or else by an increase to 0.211% in batch 250214 (load-sensing module (a)). Even the addition of 1.4% manganese in batch 250208 or of 4.6% tungsten in batch 250210 did not lead to any significant change in the volume loss in comparison with batch 320776 and 250212. The batch 250206 containing 11% iron exhibited, with 0.025±0.003 $mm^3$, a significant decrease of the volume loss in comparison with batch 320776 and 250212, to 0.025±0.003 $mm^3$, which was smaller than the maximum value from (4a). In the case of the batch 250327 containing 29% Fe, the volume loss of 0.05 $mm^3$ was comparable with that of batch 320776 and 250212. For laboratory batch 250209 with 9.8% Co also, the volume loss of 0.0642 $mm^3$ was comparable with that of batch 320776 and 250212. For the laboratory batches 250329 containing 30% Co and 250330 containing 29% Co and 10% Fe, the volume loss of 0.020 and 0.029 $mm^3$ respectively was significantly smaller than that of batch 320776 and 250212, which was smaller than the maximum value from (4a). The volume loss of the batch 250326 according to the invention was reduced to a similarly low value of 0.026 $mm^3$, which was smaller than the maximum value from (4a), by a Cr content increased to 30%.

Figure 8:
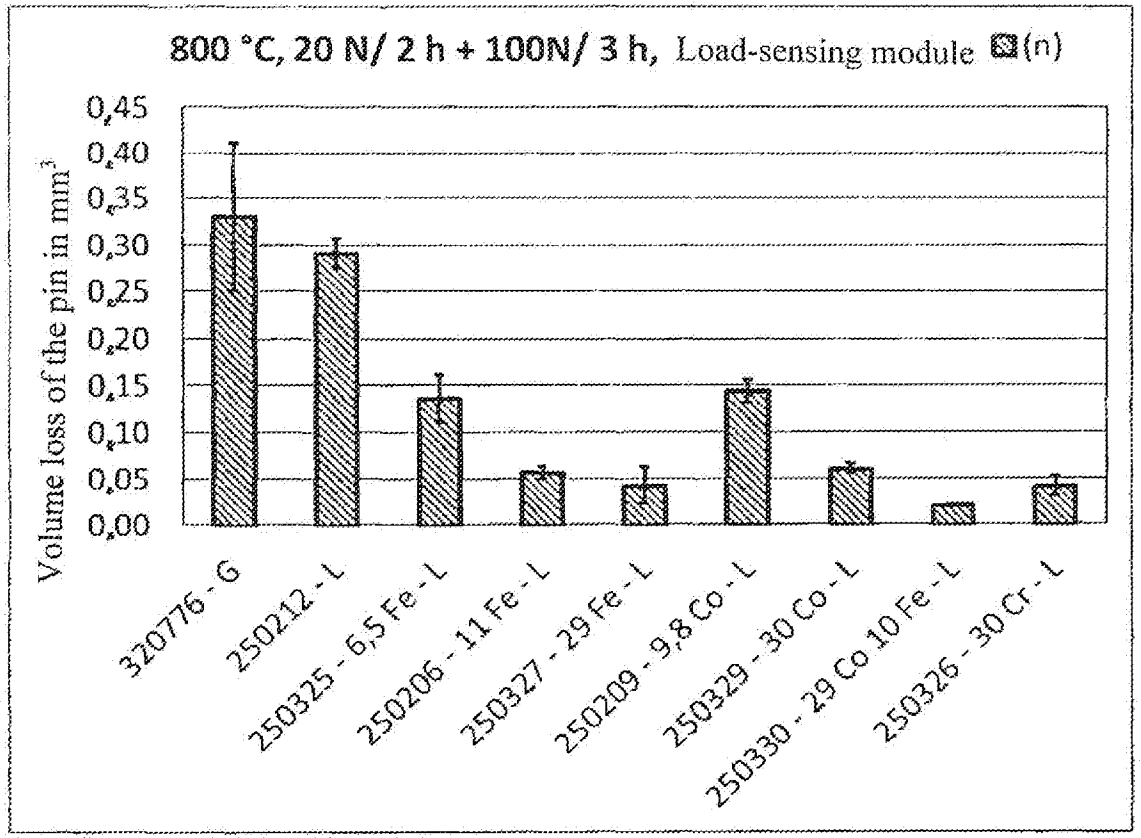
Figure 9:
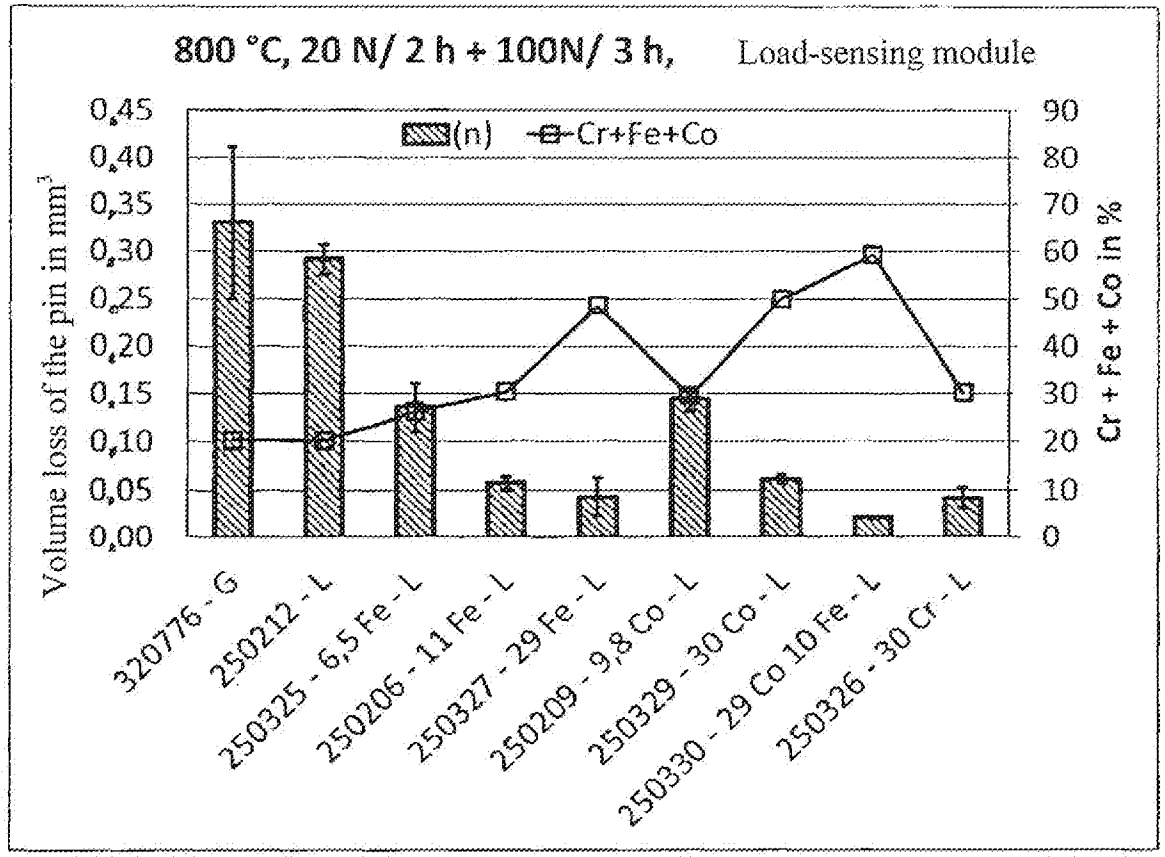

FIG. 8 shows the volume loss of the pin for the various alloys in comparison with NiCr20TiAl batch 320776 at 800° C., measured with 20 N for 2 hours followed by 100 N for 3 hours, all with sliding path 1 mm, 20 Hz with load-sensing module (n). At 800° C. also, it was confirmed that, in the high-temperature range of the wear, the reference laboratory batch 250212 of NiCr20TiAl, with 0.292±0.016 $mm^3$, had a volume loss comparable with that of the industrial-scale batch 320776, with 0.331±0.081 $mm^3$. Thus it was possible to compare the laboratory batches directly with the industrial-scale batches in terms of wear measurements at 800° C. also. The batch 250325 containing 6.5% iron exhibited, with 0.136±0.025 $mm^3$, a significant decrease of the volume loss in comparison with batch 320776 and 250212, below the maximum value of 0.156 $mm^3$ from (4a). In the case of the batch 250206 containing 11% Fe, a further decrease of the volume loss to 0.057±0.007 $mm^3$ was observed in comparison with batch 320776. In the case of 250327 containing 29% Fe, the volume loss was 0.043±0.02 $mm^3$. In both cases these are values that were significantly below the maximum value of 0.156 $mm^3$ from (4a). For laboratory batch 250209 with 9.8% Co also, the volume loss of 0.144±0.012 $mm^3$ had dropped—below the maximum value of 0.156 $mm^3$ from inequality (4a)—to a value similar to that of laboratory batch 250325 containing 6.5% iron. For laboratory batch 250329 containing 30% Co, a further decrease of the volume loss to 0.061±0.005 $mm^3$ was observed. For laboratory batch 250330 containing 29% Co and 10% Fe, the volume loss decreased once again due to the addition to Fe, to 0.021±0.001 $mm^3$. For the batch 250326 according to the invention with a Cr content increased to 30%, the volume loss dropped to a value of 0.042±0.011 $mm^3$, which was significantly below the maximum value of 0.156 $mm^3$ from inequality (4a).

Especially on the basis of the values measured at 800° C., it was found that the volume loss of the pin in the wear test could be greatly reduced by a Cr content between 25 and 35% in the alloys according to the invention. Thus the batch 250326 according to the invention containing 30% Cr exhibits a reduction of the volume loss to 0.042±0.011% $mm^3$ at 800° C. and to 0.026 $mm^3$ even at 600° C., both smaller than or equal to 50% of the volume loss of NiCr20TiAl, the respective maximum value from (4a). At 300° C. the volume loss of 0.2588 $mm^3$ was likewise below the maximum value from (4b), just as at 25° C., with 1.41±0.18 $mm^3$ (load-sensing module (n)). Therefore chromium contents between 25 and 35% are of advantage in particular for wear at higher temperatures.

In the case of laboratory batch 250209 containing 10% Co, the volume loss at 800° C. decreased to 0.144±0.012

$mm^3$, which is below the maximum value from (4a). At 25, 300 and 600° C., no increase of the wear was observed. In the case of laboratory batch 250329 containing 30% Co, the volume loss at 800° C. once again decreased significantly to 0.061±0.005 $mm^3$, which is below the maximum value from (4a). The same was found at 600° C. with a decrease to 0.020 $mm^3$, which is below the maximum value from (4a). At 25° C., the laboratory batch 250329 containing 30% Co exhibited a decrease to 0.93±0.02 $mm^3$ with load-sensing module (n). Even at 300° C., this laboratory batch, with 0.244 $mm^3$, exhibited a wear similar to that of reference batch 320776 and 250212, quite in contrast to the cobalt-base alloy Stellite 6, which at this temperature exhibited a significantly higher volume loss than reference batch 320776 and 250212. Thus the Co-containing laboratory batches satisfy the inequality (4a). Thus the optional addition of Co is advantageous. From cost viewpoints, a restriction of the optional content of cobalt to values between 0 and 15% is advantageous.

For laboratory batch 250330, a further reduction of the wear to 0.021±0.001 $mm^3$ could be achieved by addition of 10% iron in addition to 29% Co. Thus an optional content of iron between 0 and 20% is advantageous.

For the volume losses measured at 800° C., it was found on the basis of the laboratory batches 250325 (6.5% Fe), 250206 (11% Fe) and 250327 (29% Fe) that the volume loss of the pin in the wear test can be greatly reduced by an Fe content, such that it was smaller than or equal to 50% of the volume loss of NiCr20TiAl (4a) at one of the two temperatures, wherein the first % are particularly effective. Even at 25° C. and 300° C., the inequalities (4b) are satisfied by the alloys with an Fe content. Especially at 300° C., the alloys even had a volume loss reduced by more than 30%. Thus an optional content of iron between 0 and 20% is advantageous. An iron content also lowers the metal costs for this alloy.

Figure 9:
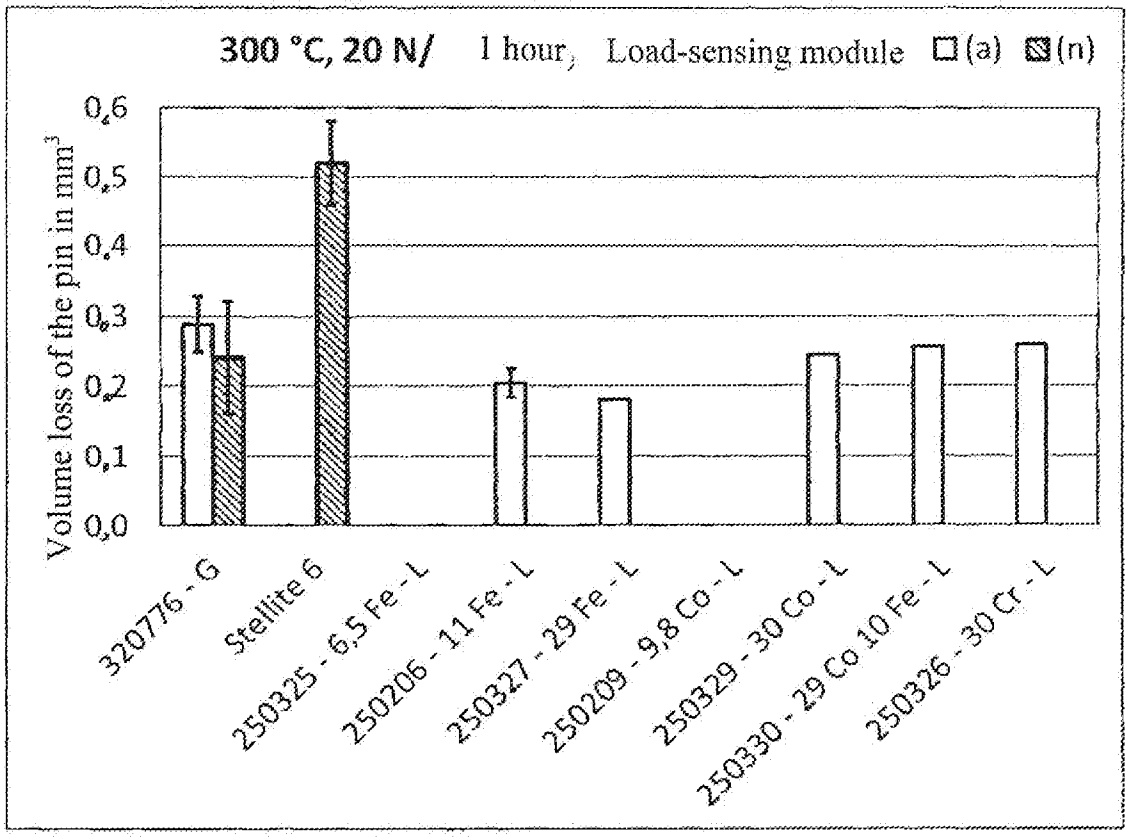

In FIG. 9, the volume loss of the pin for the various alloys from Table 7 is plotted for the case of 800° C. with 20 N for 2 hours followed by 100 N for 3 hours, all measured with sliding path 1 mm, 20 Hz with load-sensing module (n) together with the sum of Cr+Fe+Co from Formula (1) for a very good wear resistance. It is evident that the volume loss at 800° C. was smaller the larger the sum of Cr+Fe+Co was and vice versa. Thus the formula Cr+Fe+Co≥26% is a criterion for a very good wear resistance in the alloys according to the invention.

The NiCr20TiAl alloys according to the prior art, batches 320776 and 250212, had a sum of Cr+Fe+Co equal to 20.3% and 20.2% respectively, both of which are smaller than 26%, and so did not meet the criteria (4a) and (4b) for a very good wear resistance, but especially not the criteria (4a) for a good high-temperature wear resistance. The batches 250211, 250214, 250208 and 250210 also did not meet the criteria for a good high-temperature resistance, especially (4a), and had a sum of Cr+Fe+Co equal to 20.4%, 20.2%, 20.3% and 20.3% respectively, all of which are smaller than 26%. The batches 250325, 250206, 250327, 250209, 250329, 250330 and 250326 with Fe and Co additions or with an increased Cr content, especially the batch 250326, met the criteria (4a) for 800° C., in some cases even additionally for 600° C., and had a sum of Cr+Fe+Co equal to 26.4%, 30.5%, 48.6%, 29.6%, 50.0%, 59.3% and 30.3% respectively, all of which are greater than 26%. Thus they satisfied Equation (1) for a very good wear resistance.

High-Temperature Strength/Creep Strength

The offset yield strength $R_{p0.2}$ and the tensile strength $R_m$ at room temperature (RT), 600° C. and 800° C. are presented in Table 8. The measured grain sizes and the values for fh are also presented. In addition, the minimum values from the inequalities (5a) and (5b) are entered in the last row.

Figure 10:
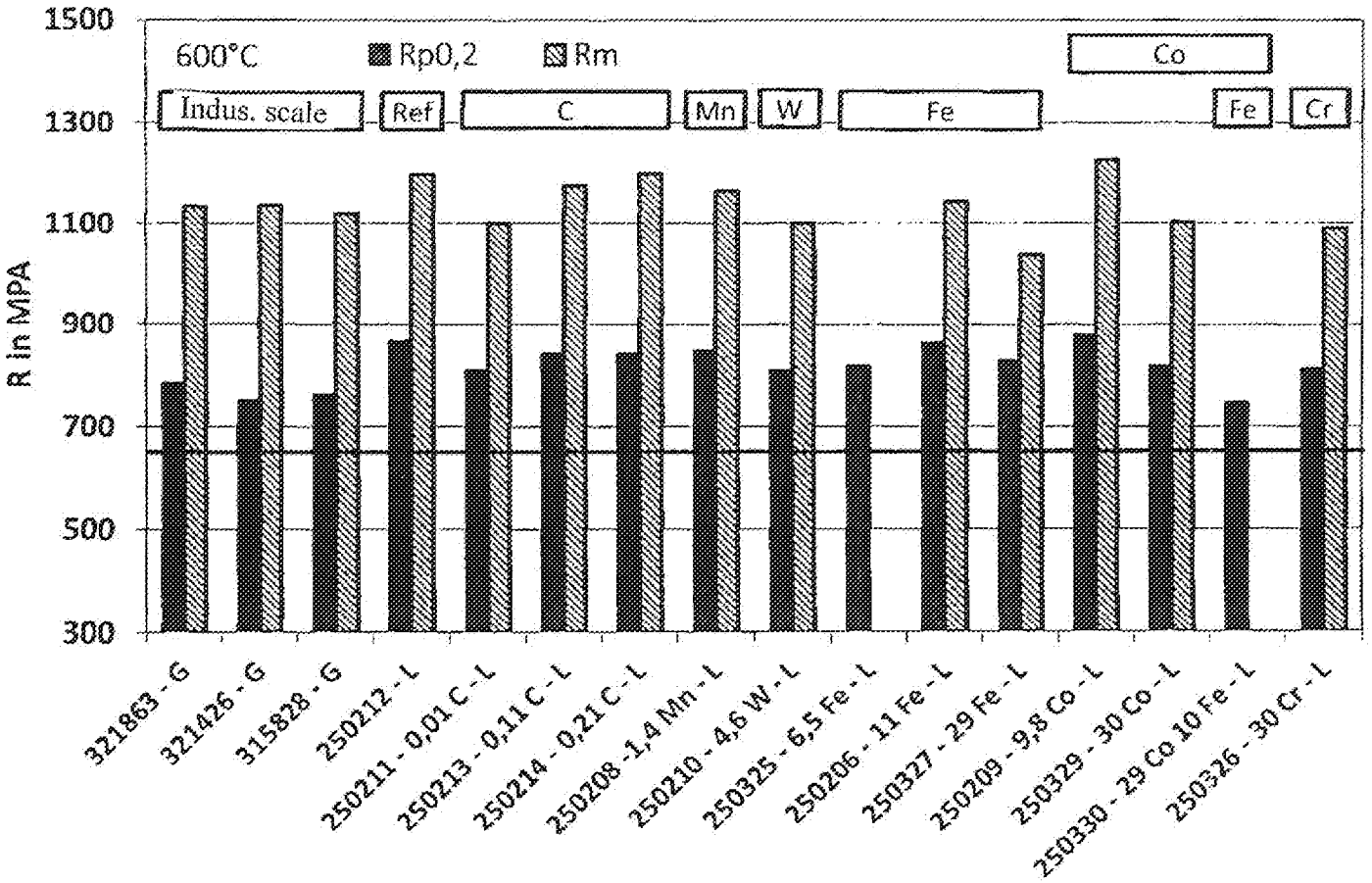
Figure 11:
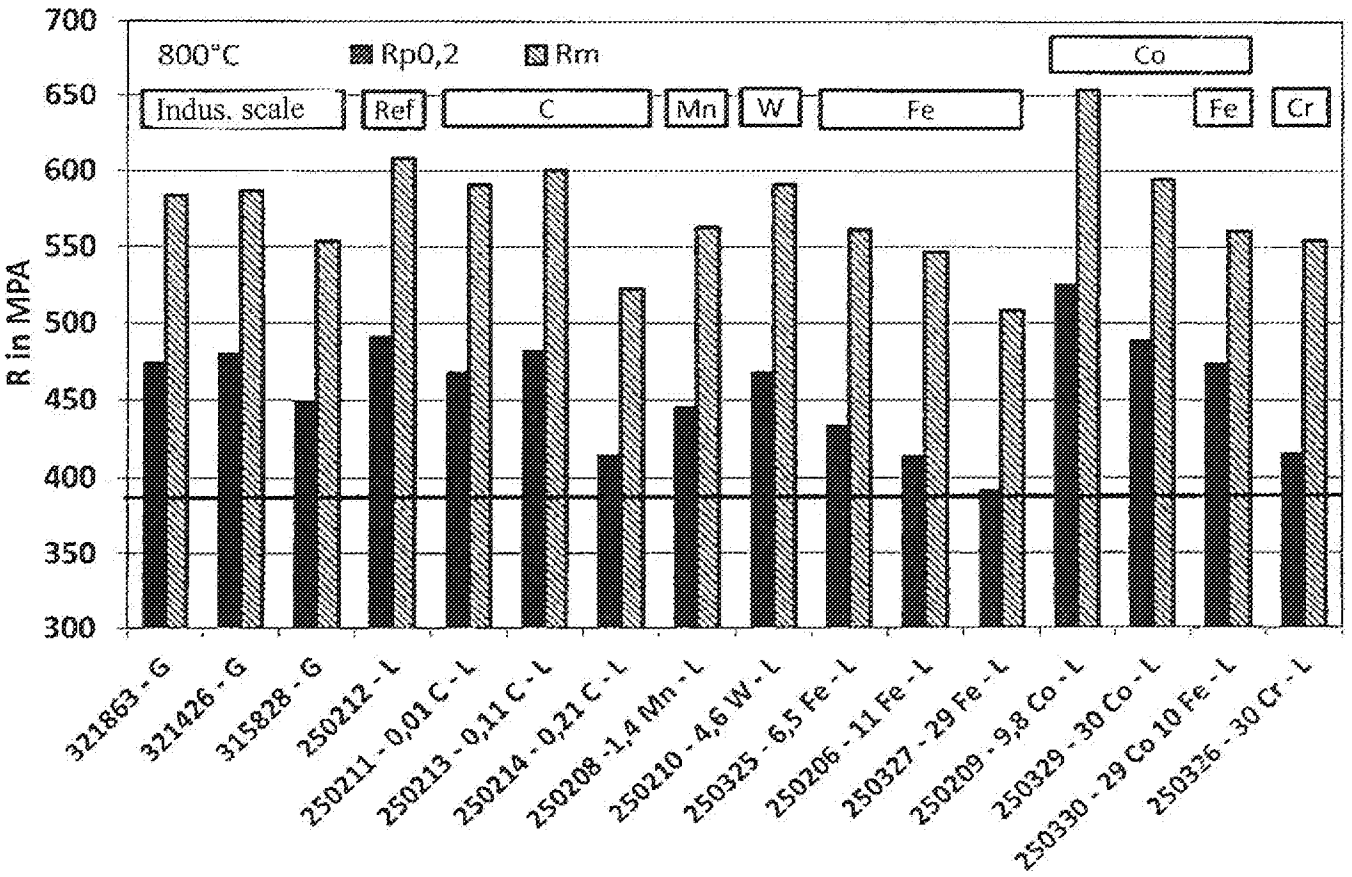

FIG. 10 shows the offset yield strength $R_{p0.2}$ and the tensile strength $R_m$ for 600° C., FIG. 11 those for 800° C. The batches 321863, 321426 and 315828 melted on an industrial scale had values between 841 and 885 MPa for the offset yield strength $R_{p0.2}$ at 600° C. and values between 472 and 481 MPa at 800° C. The reference laboratory batch 250212, with an analysis similar to that of the industrial-scale batches, had a somewhat higher aluminum content of 1.75%, which led to a slightly higher offset yield strength $R_{p0.2}$ of 866 MPa at 600° C. and of 491 MPa at 800° C.

At 600° C., as Table 8 shows, the offset yield strengths $R_{p0.2}$ of all laboratory batches (L), i.e. also of the batches (E) according to the invention, and of all industrial-scale batches (G) were greater than 650 MPa, and so criterion (5a) was met.

At 800° C., as Table 8 shows, the offset yield strengths $R_{p0.2}$ of all laboratory batches (L), i.e. also of the batches according to the invention, and of all industrial-scale batches (G) were greater than 390 MPa, and so inequality (5b) was satisfied.

A certain iron content in the alloy may be advantageous for cost reasons. Batch 250327 containing 29% Fe just satisfied this inequality (5b), since, as shown by the consideration of the laboratory batch 250212 (reference, similar to the industrial-scale batches, with Fe smaller than 3%) and also of the industrial-scale batches and of the batches 250325 (6.5% Fe), 250206 (11% Fe) and 250327 (29% Fe) according to the prior art, an increasing alloying content of Fe decreased the offset yield strength $R_{p0.2}$ in the tension test (see also FIG. 11). Therefore an optional alloying content of 20% Fe must be regarded as the upper limit for the alloy according to the invention.

The consideration of the laboratory batch 250212 (reference, similar to the industrial-scale batches, without additions of Co) and also of the industrial-scale batches and of the batches 250209 (9.8% Co) and 250329 (30% Co) showed that a content of 9.8% Co increased the offset yield strength $R_{p0.2}$ in the tension test at 800° C. to 526 MPa, while a further increase to 30% Co led again to a slight decrease to 489 MPa (see also FIG. 11). In this connection, not only the criterion (5b) but also the criterion (5c) for a particularly high high-temperature strength/creep strength is satisfied. An optional alloying content of 0% to 15% Co in the alloy according to the invention is therefore advantageous in order to obtain an offset yield strength $R_{p0.2}$ at 800° C. of greater than 390 MPa (5b), especially with simultaneous addition of iron.

The laboratory batch 250326 according to the invention showed that, with an addition of 30% Cr, the offset yield strength $R_{p0.2}$ in the tension test at 800° C. was reduced to 415 MPa, which was still well above the minimum value of 390 MPa. Therefore an alloying content of 35% Cr is regarded as the upper limit for the alloy according to the invention.

Figure 12:
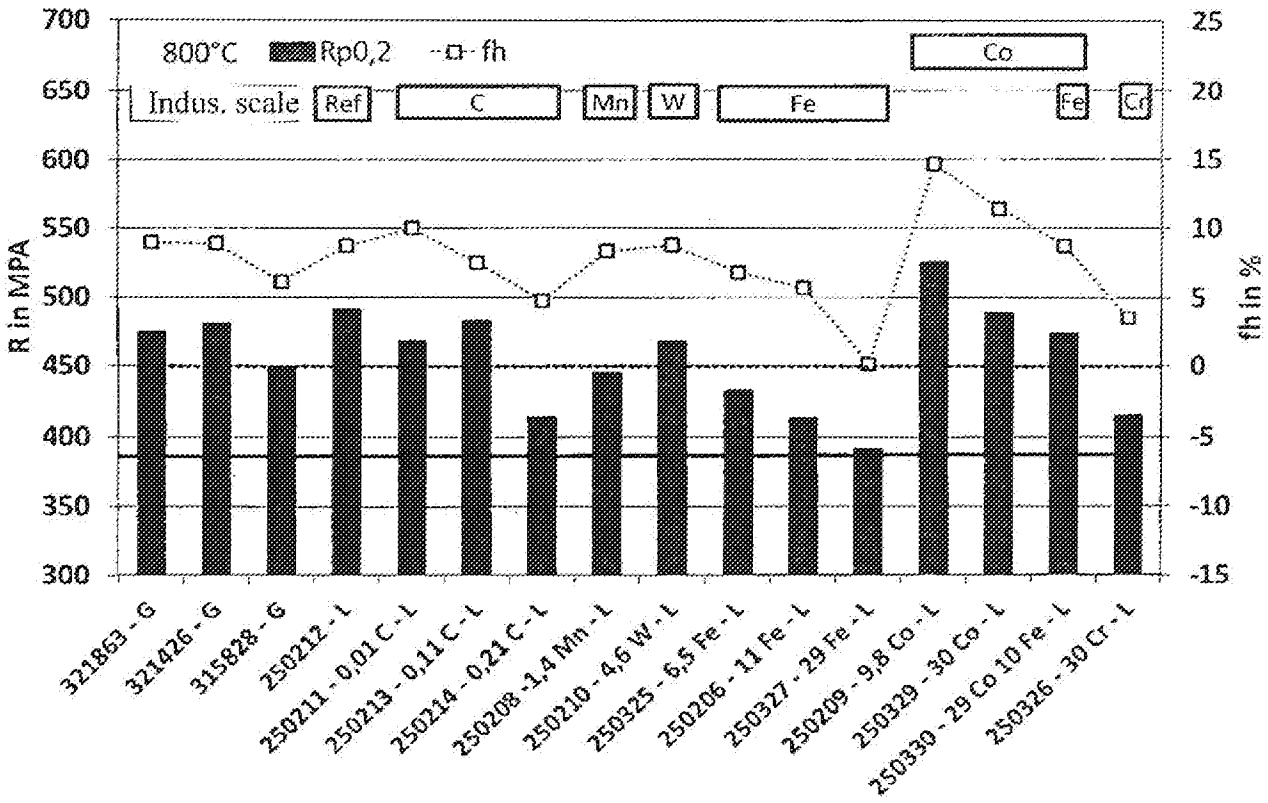

In FIG. 12, the offset yield strength $R_{p0.2}$ and fh calculated according to Formula (2) for good high-temperature strength or creep strength are plotted at 800° C. for the various alloys from Table 8. It can be clearly seen that, within the measurement accuracy, fh increases and decreases at 800° C. in the same way as the offset yield strength. Thus fh describes the offset yield strength $R_{p0.2}$ at 800° C. An fh≥0 is necessary for attainment of an adequate high-temperature strength or creep strength, as can be seen in particular for batch 250327 with $R_{p0.2}$=391 MPa, a value that is still just larger than 390 MPa. This batch, with fh=0.23%, likewise has a value that is still just larger than the minimum value of 0%. The alloy 250326 according to the invention has an fh≥3% (2c) and at the same time satisfies the inequality (5b).

Corrosion Resistance:

Table 9 shows the specific changes in mass after an oxidation test at 800° C. in air after 6 cycles of 96 h, i.e. a total of 576 h. The specific gross change in mass, the specific net change in mass and the specific change in mass of the spalled oxides after 576 h are presented in Table 9. The exemplary batches of the NiCr20TiAl alloys according to the prior art, batches 321426 and 250212, exhibited a specific gross change in mass of 9.69 and 10.84 g/m$^2$ respectively and a specific net change in mass of 7.81 and 10.54 g/m$^2$ respectively. Batch 321426 exhibited slight spalling. Batch 250326 with an increased Cr content of 30% according to the invention had a specific gross change in mass of 6.74 g/m$^2$ and a specific net change in mass of 6.84 g/m$^2$, which were below the range of the NiCr20TiAl reference alloys. The increase of the Cr content improves the corrosion resistance. Thus a Cr content of 25 to 35% is advantageous for the oxidation resistance of the alloy according to the invention.

The batches 250325 (Fe 6.5%), 250206 (Fe 11%) and 250327 (Fe 29%) exhibited a specific gross change in mass of 9.26 to 10.92 g/m$^2$ and a specific net change in mass of 9.05 to 10.61 g/m$^2$, which lie in the range of the NiCr20TiAl reference alloys. Thus an Fe content of up to 30% does not negatively influence the oxidation resistance. The Co-containing batches 250209 (Co 9.8%) and 250329 (Co 30%) also had a specific gross change in mass of 10.05 and 9.91 g/m$^2$ respectively and a specific net change in mass of 9.81 and 9.71 g/m$^2$ respectively, which likewise were in the range of the NiCr20TiAl reference alloys. The batch 250330 (29% Co, 10% Fe) behaved in just the same way, with a specific gross change in mass of 9.32 g/m- and a specific net change in mass of 8.98 g/m. Thus a Co content of up to 30% does not also negatively influence the oxidation resistance.

All alloys according to Table 5b contain Zr, which contributes as a reactive element to improvement of the corrosion resistance. Optionally, further reactive elements such as Y, La, Ce, cerium mixed metal, Hf, which improve the effectiveness in similar manner, may now be added.

Processability

Figure 13:
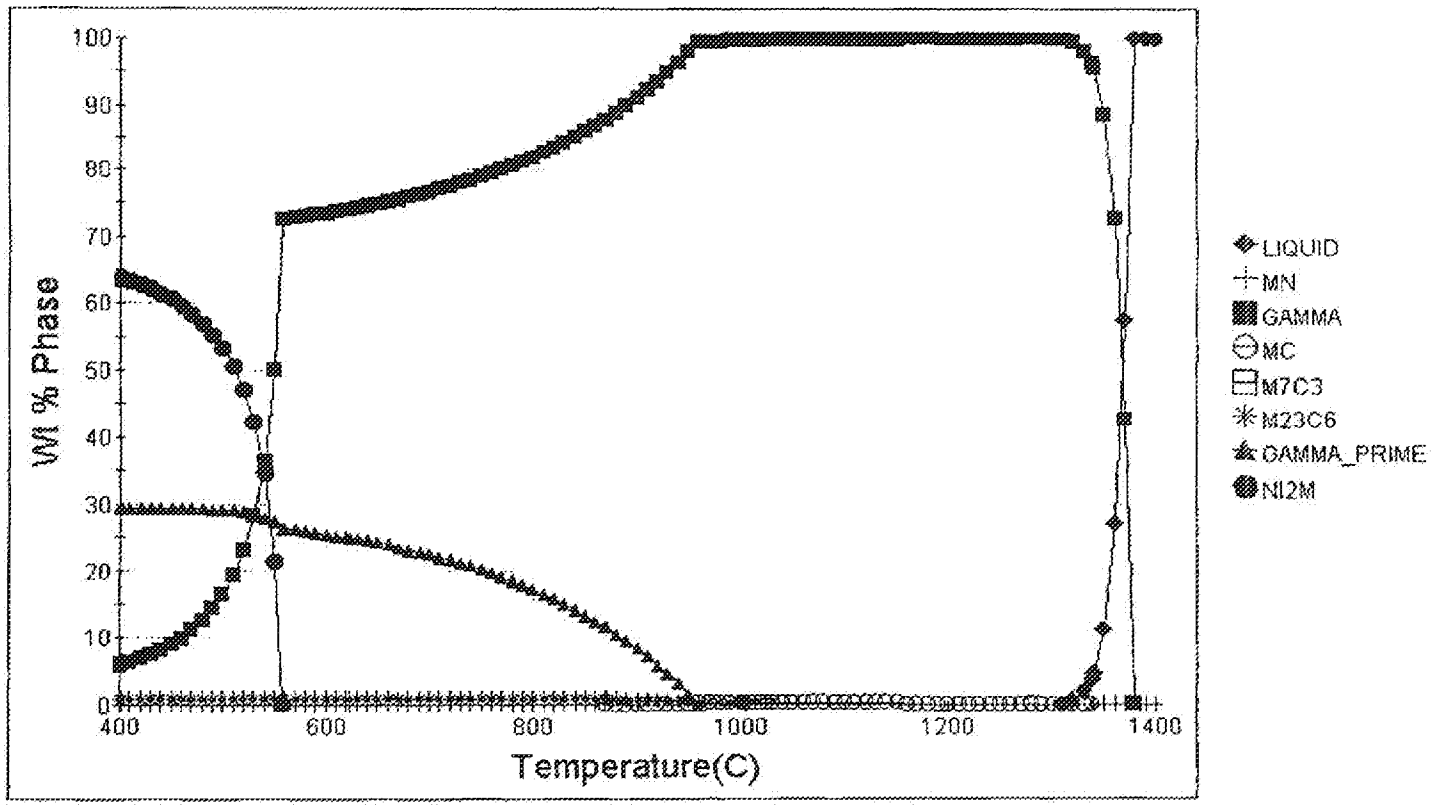

FIG. 13 shows the phase diagram of the NiCr20TiAl batch 321426 according to the prior art calculated with JMatPro. Below the solvus temperature $T_{s\gamma'}$ of 959° C., the γ' phase is formed, with a proportion of 26% at 600° C., for example. Then the phase diagram shows the formation of Ni2M (M=Cr) below 558° C., with proportions up to 64%. However, this phase is not observed during use of this material with the combinations of service temperature and time occurring in practice, and therefore does not have to be considered. In addition, FIG. 13 also shows the existence range of various carbides and nitrides, but they do not hinder the hot forming in these concentrations. The hot forming can take place only above the solvus temperature $T_{s\gamma'}$, which should be lower than or equal to 1020° C. to ensure that an adequate temperature range below the solidus temperature of 1310° C. is available for the hot forming.

The phase diagrams for the alloys in Table 5a and 5b were therefore calculated and the solvus temperature $T_{s\gamma'}$ was entered in Table 5a. The value for fver in accordance with Formula (3) was also calculated for the compositions in Tables 5a and 5b. fver is larger the higher the solvus temperature $T_{s\gamma'}$ is. All alloys in Table 5a, including the alloys according to the invention, have a calculated solvus temperature $T_{s\gamma'}$ lower than or equal to 1020° C. and meet criterion (3a): fver≤7%. The inequality fver≤7% (3a) is therefore a good criterion for obtaining an adequately broad hot-forming range and thus a good processability of the alloy.

The claimed limits for the alloys "E" according to the invention can be justified individually as follows:

Too low Cr contents mean that the Cr concentration sinks very quickly below the critical limit during use of the alloy in a corrosive atmosphere, and so a closed chromium oxide layer can no longer be formed. For an alloy with improved corrosion resistance, 25% is therefore the lower limit for chromium. Too high Cr contents raise the solvus temperature $T_{s\gamma'}$ too much, and so the processability is significantly impaired. Therefore 35% must be regarded as the upper limit.

Titanium increases the high-temperature resistance at temperatures in the range up to 900° C. by promoting the formation of the γ' phase. In order to obtain an adequate strength, at least 1.0% is necessary. Too high titanium contents raise the solvus temperature $T_{s\gamma'}$ too much, and so the processability is significantly impaired. Therefore 3.0% must be regarded as the upper limit.

Aluminum increases the high-temperature resistance at temperatures in the range up to 900° C. by promoting the formation of the γ' phase. In order to obtain an adequate strength, at least 0.6% is necessary. Too high aluminum contents raise the solvus temperature $T_{s\gamma'}$ too much, and so the processability is significantly impaired. Therefore 2.0% must be regarded as the upper limit.

Carbon improves the creep strength. A minimum content of 0.005% C is necessary for a good creep strength. Carbon is limited to maximum 0.10%, since at higher contents this element reduces the processability due to the excess formation of primary carbides.

A minimum content of 0.0005% N is necessary for cost reasons. N is limited to maximum 0.050%, since this element reduces the processability due to the formation of coarse carbonitrides.

The content of phosphorus should be lower than or equal to 0.030%, since this surface-active element impairs the oxidation resistance. A too-low phosphorus content increases the cost. The phosphorus content is therefore ≥0.0005%.

The contents of sulfur should be adjusted as low as possible, since this surface-active element impairs the oxidation resistance and the processability. Therefore max. 0.010% S is specified.

The oxygen content must be lower than or equal to 0.020%, in order to ensure manufacturability of the alloy.

Too high contents of silicon impair the processability. The Si content is therefore limited to 0.70%.

Manganese is limited to 2.0%, since this element reduces the oxidation resistance.

Even very low Mg contents and/or Ca contents improve the processing by the binding of sulfur, whereby the occurrence of low-melting NiS eutectics is prevented. At too high contents, intermetallic Ni—Mg phases or Ni—Ca phases may occur, which again significantly impair the processability. The Mg content or the Ca content is therefore limited respectively to maximum 0.05%.

Molybdenum is limited to max. 2.0%, since this element reduces the oxidation resistance.

Tungsten is limited to max. 2.0%, since this element likewise reduces the oxidation resistance and at the carbon contents possible in wrought alloys has no measurable positive effect on the wear resistance.

Niobium increases the high-temperature resistance. Higher contents increase the costs very greatly. The upper limit is therefore set at 0.5%.

Copper is limited to max. 0.5%, since this element reduces the oxidation resistance.

Vanadium is limited to max. 0.5%, since this element reduces the oxidation resistance.

Iron increases the wear resistance, especially in the high-temperature range. It also lowers the costs. It may therefore be present optionally between 0 and 20% in the alloy. Too high iron contents reduce the yield strength too much, especially at 800° C. Therefore 20% must be regarded as the upper limit.

Cobalt increases the wear resistance and the high-temperature strength/creep strength, especially in the high-temperature range. It also lowers the costs. It may therefore be present optionally between 0 and 20% in the alloy. Too high cobalt contents increase the costs too much. Therefore 20% must be regarded as the upper limit.

If necessary, the alloy may also contain Zr, in order to improve the high-temperature resistance and the oxidation resistance. For cost reasons, the upper limit is set at 0.20% Zr, since Zr is a rare element.

If necessary, boron may be added to the alloy, since boron improves the creep strength. Therefore a content of at least 0.0001% should be present. At the same time, this surface-active element impairs the oxidation resistance. Therefore max. 0.008% boron is specified.

Nickel stabilizes the austenitic matrix and is needed for formation of the γ' phase, which contributes to the high-temperature strength/creep strength. At a nickel content below 35%, the high-temperature strength/creep strength is reduced too much, and so 35% is the lower limit.

The following relationship between Cr, Fe and Co must be satisfied, to ensure, as was explained in the examples, that an adequate wear resistance is achieved:

$$Cr+Fe+Co \geq 26\% \quad (1)$$

wherein Cr, Fe and Co are the concentrations of the elements in question in mass-%.

Furthermore, the following relationship must be satisfied, to ensure than an adequate strength at higher temperatures is achieved:

$$fh \geq 0 \text{ with} \quad (2a)$$

$$fh = 6.49+3.88Ti+1.36Al-0.301Fe+(0.759-0.0209Co)Co-0.428Cr-28.2C \quad (2)$$

wherein Ti, Al, Fe, Co, Cr and C are the concentrations of the elements in question in mass-% and fh is expressed in %. The limits for fh were justified in detail in the foregoing text.

If necessary, the oxidation resistance may be further improved with additions of oxygen-affine elements such as yttrium, lanthanum, cerium, hafnium. They do this by becoming incorporated in the oxide layer and blocking the diffusion paths of the oxygen at the grain boundaries therein.

For cost reasons, the upper limit of yttrium is defined as 0.20%, since yttrium is a rare element.

For cost reasons, the upper limit of lanthanum is defined as 0.20%, since lanthanum is a rare element.

For cost reasons, the upper limit of cerium is defined as 0.20%, since cerium is a rare element.

Instead of Ce and/or La, it is also possible to use cerium mixed metal. For cost reasons, the upper limit of cerium mixed metal is defined as 0.20%.

For cost reasons, the upper limit of hafnium is defined as 0.20%, since hafnium is a rare element.

If necessary, the ally may also contain tantalum, since tantalum also increases the high-temperature resistance by promoting the γ' phase formation. Higher contents raise the costs very greatly, since tantalum is a rare element. The upper limit is therefore set at 0.60%.

Pb is limited to max. 0.002%, since this element reduces the oxidation resistance and the high-temperature resistance. The same applies for Zn and Sn.

Furthermore, the following relationship between Cr, Mo, W, Fe, Co, Ti, Al and Nb must be satisfied, to ensure that an adequate processability is achieved:

$$fver \leq 7 \text{ with} \quad (3a)$$

$$fver = 32.77+0.5932Cr+0.3642Mo+0.513W+(0.3123-0.0076Fe)Fe+(0.3351-0.003745Co-0.0109Fe)Co+40.67TiAl+33.28Al^2-13.6TiAl^2-22.99Ti-92.7Al+2.94Nb \quad (3)$$

wherein Cr, Mo, W, Fe, Co, Ti, Al and Nb are the concentrations of the elements in question in mass-% and fver is expressed in %. The limits for fh were justified in detail in the foregoing text.

TABLE 1

Composition of the nickel alloys for outlet valves mentioned in DIN EN 10090. All data in mass-%.

| Designation | | Chemical composition, proportion by mass in % | | | | | | | | | | | |
|---|---|---|---|---|---|---|---|---|---|---|---|---|---|
| Short name | Material number | C | Si | Mn | P max. | S max. | Cr | Mo | Ni | Fe | Al | Ti | Other |
| NiFe25Cr20NbTi | 2.4955 | 0.04-10 | max. 1.0 | max. 1.0 | 0.030 | 0.015 | 18.00-21.00 | | Rest | 23.00-28.00 | 0.30-1.00 | 1.00-2.00 | Nb + Ta: 1.00-2.00<br>B: max. 0.008 |
| NiCr20TiAl | 2.4952 | 0.04-10 | max. 1.0 | max. 1.0 | 0.020 | 0.015 | 16.00-21.00 | | min. 65 | max. 3.00 | 1.00-1.80 | 1.80-2.70 | Cu: max. 0.2<br>Co: max. 2.00<br>B: max. 0.008 |

TABLE 2

Reference values for the tensile strength at elevated temperatures of the nickel alloys for outlet valves mentioned in DIN EN 10090 (+AT solution-annealed: 10000 to 1080° C. air or water cooling, +P precipitation-hardened: 890 to 710/16 h in air; [1]) The values indicated

| Designation | | | Tensile strength[1]) in N/mm² at | | | | | | |
|---|---|---|---|---|---|---|---|---|---|
| Short name | Material number | Reference heat treatment condition | 500° C. | 550° C. | 600° C. | 650° C. | 700° C. | 750° C. | 800° C. |
| NiFe25Cr20NbTi | 2.4955 | +AT +P | 800 | 800 | 790 | 740 | 640 | 500 | 340 |
| NiCr20TiAl | 2.4952 | +AT +P | 1050 | 1030 | 1000 | 930 | 820 | 680 | 500 |

TABLE 3

Reference values for the 0.2% offset yield strength at elevated temperatures of the nickel alloys for outlet valves mentioned in DIN EN 10090 (+AT solution-annealed: 1000 to 1080° C. air or water cooling, +P precipitation-hardened: 890 to 710/16 h in air; [1]) The values indicated here lie in the neighborhood of the lower scatter band)

| Designation | | | 0.2% offset yield strength[1]) in N/mm² at | | | | | | |
|---|---|---|---|---|---|---|---|---|---|
| Short name | Material number | Reference heat treatment condition | 500° C. | 550° C. | 600° C. | 650° C. | 700° C. | 750° C. | 800° C. |
| NiFe25Cr20NbTi | 2.4955 | +AT +P | 450 | 450 | 450 | 450 | 430 | 380 | 250 |
| NiCr20TiAl | 2.4952 | +AT +P | 700 | 650 | 650 | 600 | 600 | 500 | 450 |

TABLE 4

Reference values for the creep rupture stress strength after 1000 hours at elevated temperatures of the nickel alloys for outlet valves mentioned in DIN EN 10090 (+AT solution-annealed: 1000 to 1080° C. air or water cooling, +P precipitation-hardened: 890 to 710/16 h in air; [1]) Mean values of the previously recorded scatter band)

| Designation | | | Creep strength[1]) in N/mm² at | | | |
|---|---|---|---|---|---|---|
| Short name | Material number | Reference heat treatment condition | 500° C. | 600° C. | 725° C. | 800° C. |
| NiFe25Cr20NbTi | 2.4955 | +AT +P | — | 400 | 180 | 60 |
| NiCr20TiAl | 2.4952 | +AT +P | — | 500 | 290 | 150 |

TABLE 5a

Composition of the industrial-scale and of the laboratory batches, Part 1. All concentration data in mass-% (T: alloy according to the prior art, E: alloy according to the invention, L: melted on the laboratory scale, G: melted on the industrial scale)

| | | Batch | Alloy | C | Cr | Ni | Mn | Si | Mo | Ti | Nb | Fe | Al | W | Co | Ts, γ' in ° C. | Fver in % |
|---|---|---|---|---|---|---|---|---|---|---|---|---|---|---|---|---|---|
| T | G | 320776 | NiCr20TiAl | 0.053 | 20.0 | 75.1 | 0.03 | <0.01 | 0.07 | 2.68 | <0.01 | 0.30 | 1.62 | <0.01 | 0.03 | 960 | 1.24 |
| T | G | 321863 | NiCr20TiAl | 0.049 | 19.8 | 75.9 | <0.01 | 0.02 | 0.02 | 2.67 | <0.01 | 0.69 | 1.62 | <0.01 | 0.01 | 958 | 1.16 |
| T | G | 321426 | NiCr20TiAl | 0.049 | 20.0 | 75.1 | <0.01 | 0.04 | 0.02 | 2.62 | <0.01 | 0.28 | 1.65 | <0.01 | 0.07 | 959 | 0.97 |
| T | G | 315828 | NiCr20TiAl | 0.077 | 20.0 | 73.5 | <0.01 | 0.02 | 0.02 | 2.35 | <0.01 | 2.45 | 1.45 | <0.01 | 0.01 | 931 | −1.74 |
| T | L | 250212 | NiCr20TiAl (Ref.) | 0.066 | 20.1 | 75.1 | <0.01 | 0.02 | 0.02 | 2.67 | <0.01 | 0.06 | 1.75 | <0.01 | 0.01 | 973 | 1.86 |
| | L | 250211 | NiCr20Tl2.5Al2C01 | 0.009 | 20.3 | 75.1 | <0.01 | 0.01 | 0.01 | 2.61 | <0.01 | 0.06 | 1.72 | <0.01 | 0.01 | 970 | 1.40 |
| | L | 250213 | NiCr20Tl2.5Al2C1 | 0.111 | 20.1 | 75.2 | <0.01 | 0.01 | 0.02 | 2.71 | <0.01 | 0.06 | 1.69 | <0.01 | 0.01 | 963 | 1.78 |
| | L | 250214 | NiCr20Tl2.5Al2C2 | 0.212 | 20.1 | 75.0 | <0.01 | 0.02 | 0.02 | 2.72 | <0.01 | 0.05 | 1.72 | <0.01 | 0.01 | 968 | 2.03 |

TABLE 5a-continued

Composition of the industrial-scale and of the laboratory batches, Part 1. All concentration data in mass-% (T: alloy according to the prior art, E: alloy according to the invention, L: melted on the laboratory scale, G: melted on the industrial scale)

| | | Batch | Alloy | C | Cr | Ni | Mn | Si | Mo | Ti | Nb | Fe | Al | W | Co | Ts, γ' in ° C. | Fver in % |
|---|---|---|---|---|---|---|---|---|---|---|---|---|---|---|---|---|---|
| | L | 250208 | NiCr20Tl2.5Al2Mn1.5 | 0.057 | 20.1 | 74.1 | 1.38 | 0.03 | 0.02 | 2.59 | <0.01 | 0.15 | 1.53 | <0.01 | 0.01 | 957 | −0.01 |
| | L | 250210 | NiCr20Tl2.5Al2W5 | 0.060 | 20.1 | 70.6 | <0.01 | 0.02 | 0.02 | 2.61 | <0.01 | 0.06 | 1.75 | 4.56 | 0.12 | 990 | 3.83 |
| | L | 250325 | NiCr20Tl2.5Al2Fe7 | 0.057 | 19.9 | 69.0 | <0.01 | 0.01 | 0.02 | 2.58 | <0.01 | 6.54 | 1.77 | <0.01 | 0.01 | 980 | 2.98 |
| | L | 250206 | NiCr20Tl2.5Al2Fe10 | 0.066 | 20.0 | 64.8 | <0.01 | 0.06 | 0.02 | 2.69 | <0.01 | 10.52 | 1.71 | <0.01 | 0.01 | 990 | 4.13 |
| | L | 250327 | NiCr20Tl2.5Al2Fe30 | 0.060 | 19.9 | 46.9 | <0.01 | 0.02 | <0.01 | 2.62 | 0.01 | 28.72 | 1.77 | 0.030 | <0.01 | 989 | 4.22 |
| | L | 250209 | NiCr20Tl2.5Al2Co10 | 0.063 | 19.9 | 65.4 | 0.12 | 0.19 | 0.02 | 2.76 | <0.01 | 0.08 | 1.69 | <0.01 | 9.75 | 996 | 4.85 |
| | L | 250329 | NiCr20Tl2.4Al1.46Co30 | 0.064 | 20.4 | 45.6 | <0.01 | 0.13 | <0.01 | 2.41 | 0.01 | 0.07 | 1.49 | <0.01 | 29.61 | 1000 | 5.14 |
| | L | 250330 | NiCr20Tl2.4Al1.5Fe10Co30 | 0.063 | 20.4 | 36.4 | <0.01 | 0.06 | 0.01 | 2.42 | 0.01 | 9.71 | 1.51 | <0.01 | 29.21 | 995 | 4.54 |
| E | L | 250326 | NiCr30Tl2.4Al1.5 | 0.063 | 30.2 | 65.3 | <0.01 | 0.04 | 0.01 | 2.46 | <0.01 | 0.1 | 1.59 | 0.01 | <0.01 | 1006 | 5.40 |

TABLE 5b

Composition of the industrial-scale and of the laboratory batches, Part 2. All concentration data in mass-%. P = 0.0002%, Sn <0.01%, Se <0.0003%, Te <0.0001%, Bi <0.00003%, Sb <0.0005%, Ag <0.0001% (T: alloy according to the prior art, E: alloy according to the invention, L: melted on the laboratory scale, G: melted on the industrial scale)

| | | Batch | Alloy | S | N | Cu | P | Mg | Ca | V |
|---|---|---|---|---|---|---|---|---|---|---|
| T | G | 320776 | NiCr20TiAl | <0.002 | 0.005 | <0.01 | 0.006 | <0.001 | <0.01 | 0.01 |
| T | G | 321863 | NiCr20TiAl | <0.002 | 0.007 | 0.01 | 0.006 | <0.001 | <0.01 | 0.01 |
| T | G | 321426 | NiCr20TiAl | <0.002 | 0.006 | <0.01 | 0.006 | <0.001 | <0.01 | <0.01 |
| T | G | 315828 | NiCr20TiAl | 0.001 | 0.007 | <0.01 | 0.006 | 0.006 | <0.01 | 0.01 |
| T | L | 250212 | NiCr20TiAl (Ref) | 0.004 | 0.001 | <0.01 | 0.006 | 0.014 | <0.001 | <0.01 |
| | L | 250211 | NiCr20Tl2.5Al2C01 | 0.003 | 0.002 | <0.01 | 0.006 | 0.013 | <0.001 | <0.01 |
| | L | 250213 | NiCr20Tl2.5Al2C1 | 0.004 | 0.004 | <0.01 | 0.006 | 0.013 | <0.001 | <0.01 |
| | L | 250214 | NiCr20Tl2.5Al2C2 | 0.003 | 0.001 | <0.01 | 0.006 | 0.013 | <0.001 | <0.01 |
| | L | 250208 | NiCr20Tl2.5Al2Mn1.5 | 0.003 | 0.002 | <0.01 | 0.006 | 0.016 | <0.001 | <0.01 |
| | L | 250210 | NiCr20Tl2.5Al2W5 | 0.003 | 0.003 | 0.01 | 0.006 | 0.010 | 0.001 | <0.01 |
| | L | 250325 | NiCr20Tl2.5Al2Fe7 | 0.003 | 0.001 | <0.01 | 0.006 | 0.014 | 0.001 | <0.01 |
| | L | 250206 | NiCr20Tl2.5Al2Fe10 | 0.003 | 0.002 | <0.01 | 0.006 | 0.011 | 0.001 | <0.01 |
| | L | 250327 | NiCr20Tl2.5Al2Fe30 | 0.003 | 0.004 | <0.01 | 0.004 | 0.008 | 0.001 | <0.01 |
| | L | 250209 | NiCr20Tl2.5Al2Co10 | 0.002 | 0.001 | <0.01 | 0.006 | 0.010 | <0.001 | <0.01 |
| | L | 250329 | NiCr20Tl2.4Al1.5Co30 | 0.003 | 0.004 | <0.01 | 0.004 | 0.006 | 0.001 | <0.01 |
| | L | 250330 | NiCr20Tl2.4Al1.5Fe10Co30 | 0.003 | 0.003 | <0.01 | 0.004 | 0.007 | 0.001 | <0.01 |
| E | L | 250326 | NiCr30Tl2.4Al1.5 | 0.003 | 0.007 | <0.01 | <0.002 | 0.009 | <0.01 | <0.01 |

| | | Batch | Alloy | Zr | W | Y | La | B | Hf | Ta | Ce | O |
|---|---|---|---|---|---|---|---|---|---|---|---|---|
| T | G | 320776 | NiCr20TiAl | 0.05 | <0.01 | — | — | 0.002 | | 0.02 | — | — |
| T | G | 321863 | NiCr20TiAl | 0.05 | <0.01 | — | — | 0.002 | | 0.02 | — | — |
| T | G | 321426 | NiCr20TiAl | 0.05 | <0.01 | — | — | 0.002 | | 0.02 | — | — |
| T | G | 315828 | NiCr20TiAl | 0.08 | <0.01 | — | — | 0.004 | | 0.02 | — | — |
| T | L | 250212 | NiCr20TiAl (Ref) | 0.06 | <0.01 | — | — | <0.001 | — | 0.02 | — | 0.006 |
| | L | 250211 | NiCr20Tl2.5Al2C01 | 0.08 | <0.01 | — | — | 0.001 | — | 0.02 | — | 0.004 |
| | L | 250213 | NiCr20Tl2.5Al2C1 | 0.08 | <0.01 | — | — | 0.001 | — | 0.02 | — | 0.004 |
| | L | 250214 | NiCr20Tl2.5Al2C2 | 0.07 | <0.01 | — | — | <0.001 | — | 0.02 | — | 0.005 |
| | L | 250208 | NiCr20Tl2.5Al2Mn1.5 | 0.07 | <0.01 | — | — | 0.001 | — | 0.02 | — | 0.005 |
| | L | 250210 | NiCr20Tl2.5Al2W5 | 0.07 | 4.56 | — | — | <0.001 | — | 0.02 | — | 0.003 |
| | L | 250325 | NiCr20Tl2.5Al2Fe7 | 0.10 | <0.01 | — | — | 0.002 | — | — | — | 0.005 |
| | L | 250206 | NiCr20Tl2.5Al2Fe10 | 0.08 | <0.01 | — | — | 0.002 | — | 0.02 | — | 0.005 |
| | L | 250327 | NiCr20Tl2.5Al2Fe30 | 0.08 | 0.03 | — | — | <0.001 | — | — | — | 0.001 |
| | L | 250209 | NiCr20Tl2.5Al2Co10 | 0.09 | <0.01 | — | — | 0.002 | — | 0.02 | — | 0.004 |
| | L | 250329 | NiCr20Tl2.4Al1.5Co30 | 0.07 | <0.01 | — | — | <0.001 | — | — | — | 0.002 |
| | L | 250330 | NiCr20Tl2.4Al1.5Fe10Co30 | 0.08 | <0.01 | — | — | <0.001 | — | — | — | 0.003 |
| E | L | 250326 | NiCr30Tl2.4Al1.5 | 0.09 | 0.01 | — | — | <0.001 | <0.01 | 0.02 | — | 0.003 |

TABLE 6

Results of the grain-size determination and of the hardness measurement HV30 at room temperature (RT) before (HV30_r) and after (HV30_h) the age-hardening annealing (850° C. for 4 h/cooling in air followed by an annealing at 700 C. for 16 h/ cooling in air); KG = grain size. (T: alloy according to the prior art, E: alloy according to the invention, L: melted on the laboratory scale, G: melted on the industrial scale)

| | | Batch | Alloy | KG in μm | HV30_r | HV30_h |
|---|---|---|---|---|---|---|
| T | G | 320776 | NiCr20TiAl | 21 | 333 | 380 |
| T | G | 321426 | NiCr20TiAl | 32 | 320 | 370 |
| T | G | 315828 | NiCr20TiAl | 24 | | 366 |
| T | L | 250212 | NiCr20TiAl (Ref) | 30 | 352 | 397 |
| | L | 250211 | NiCr20Tl2.5Al2C01 | 52 | 324 | 379 |
| | L | 250214 | NiCr20Tl2.5Al2C2 | 22 | 386 | 413 |
| | L | 250208 | NiCr20Tl2.5Al2Mn1.5 | 30 | 358 | 392 |
| | L | 250210 | NiCr20Tl2.5Al2W5 | 24 | 395 | 416 |
| | L | 250325 | NiCr20Tl2.5Al2Fe7 | 40 | 332 | 377 |
| | L | 250206 | NiCr20Tl2.5Al2Fe10 | 29 | 366 | 392 |
| | L | 250327 | NiCr20Tl2.5Al2Fe30 | 50 | 331 | 366 |
| | L | 250209 | NiCr20Tl2.5Al2Co10 | 26 | 365 | 411 |
| | L | 250329 | NiCr20Tl2.4Al1.5Co30 | 35 | 340 | 378 |
| | L | 250330 | NiCr20Tl2.4Al1.5Fe10Co30 | 42 | 274 | 346 |
| E | L | 250326 | NiCr30Tl2.4Al1.5 | 31 | 342 | 366 |

TABLE 7

Wear volume of the pin in $mm^3$ at a load of 20 N with a sliding path of one mm, a frequency of 20 Hz and a relative humidity of approximately 45% of the industrial scale and of the laboratory batches. (T: alloy according to the prior art, E: alloy according to the invention, L: melted on the laboratory scale, G: melted on the industrial scale; (a) 1st measuring system, (n) 2nd measuring system). The mean values ± standard deviation are indicated. In case of individual values, the standard deviation is missing.

| | | | | | Wear value of the pin in $mm^2$ | | | | |
|---|---|---|---|---|---|---|---|---|---|
| | | | | | 25° C. | | | 300° C. | |
| | | Batch | Alloy | Cr + Fe + Co in % | 20 N, 1 h (a) | 20 N, 10 h (a) | 20 N, 1 h (n) | 20 N, 1 h (a) | 20 N, 1 h (n) |
| T | | Ref | Stellite 6 | Ca. 80 | | | 0.16 ± 0.063 | | 0.52 ± 0.06 |
| T | G | 320776 | NiCr20TiAl | 20.3 | 0.7 ± 0.04 | 1.48 ± 0.11 | 1.14 ± 0.08 | 0.288 ± 0.04 | 0.24 ± 0.06 |
| T | L | 250212 | NiCr20TiAl (Ref) | 20.2 | 0.67 ± 0.16 | | | | |
| | L | 250211 | NiCr20Tl2.5Al2C01 | 20.4 | | 1.49 | | | |
| | L | 250214 | NiCr20Tl2.5Al2C2 | 20.2 | | 1.52 | | | |
| | L | 250208 | NiCr20Tl2.5Al2Mn1.5 | 20.3 | | | | | |
| | L | 250210 | NiCr20Tl2.5Al2W5 | 20.3 | | | | | |
| | L | 250325 | NiCr20Tl2.5Al2Fe7 | 26.4 | 0.66 ± 0.02 | | 1.06 ± 0.11 | | |
| | L | 250206 | NiCr20Tl2.5Al2Fe10 | 30.5 | 0.82 ± 0.09 | | 1.23 ± 0.06 | 0.205 ± 0.02 | |
| | L | 250327 | NiCr20Tl2.5Al2Fe30 | 48.6 | 0.88 ± 0.06 | | 1.31 ± 0.03 | 0.182 | |
| | L | 250209 | NiCr20Tl2.5Al2Co10 | 29.6 | 0.74 | | 1.04 ± 0.01 | | |
| | L | 250329 | NiCr20Tl2.4Al1.5Co30 | 50.0 | 0.56 ± 0.04 | | 0.79 ± 0.06 | 0.244 | |
| | L | 250330 | NiCr20Tl2.4Al1.5Fe10Co30 | 59.3 | 0.65 ± 0.07 | | 0.93 ± 0.02 | 0.256 | |
| E | L | 250325 | NiCr20Tl2.4Al1.5 | 30.3 | 0.79 | | 1.41 ± 0.18 | 0.2588 | |
| | | | Maximum values from (4a) and (4b) | | ≤0.89 | | ≤1.48 | ≤0.37 | |

| | | | | Wear value of the pin in $mm^2$ | | | | |
|---|---|---|---|---|---|---|---|---|
| | | | | 600° C. | | 800° C. | | |
| | | Batch | Alloy | 20 N, 10 h (a) | 20 N, 10 h (n) | 20 N, 10 h (a) | 20 N, 10 h (n) | 20 N, 2 h + 100 N, 3 h (n) |
| T | | Ref | Stellite 6 | | 0.009 ± 0.002 | | 0.007 | |
| T | G | 320776 | NiCr20TiAl | 0.053 ± 0.0028 | 0.03 ± 0.004 | 0.0117 ± 0.01 | 0.057 ± 0.02 | 0.331 ± 0.081 |
| T | L | 250212 | NiCr20TiAl (Ref) | 0.066 ± 0.02 | | | | 0.292 ± 0.016 |
| | L | 250211 | NiCr20Tl2.5Al2C01 | 0.0633 | | | | |
| | L | 250214 | NiCr20Tl2.5Al2C2 | 0.05239 | | | | |
| | L | 250208 | NiCr20Tl2.5Al2Mn1.5 | 0.054 ± 0.021 | | | | |
| | L | 250210 | NiCr20Tl2.5Al2W5 | 0.055 ± 0.16 | | | | |
| | L | 250325 | NiCr20Tl2.5Al2Fe7 | | | | | 0.138 ± 0.025 |
| | L | 250206 | NiCr20Tl2.5Al2Fe10 | 0.025 ± 0.003 | | | | 0.057 ± 0.007 |
| | L | 250327 | NiCr20Tl2.5Al2Fe30 | 0.050 | | | | 0.043 ± 0.02 |
| | L | 250209 | NiCr20Tl2.5Al2Co10 | 0.0642 | | | | 0.144 ± 0.012 |

TABLE 7-continued

Wear volume of the pin in $mm^3$ at a load of 20 N with a sliding path of one mm, a frequency of 20 Hz and a relative humidity of approximately 45% of the industrial scale and of the laboratory batches. (T: alloy according to the prior art, E: alloy according to the invention, L: melted on the laboratory scale, G: melted on the industrial scale; (a) 1st measuring system, (n) 2nd measuring system). The mean values ± standard deviation are indicated. In case of individual values, the standard deviation is missing.

| | | | | | |
|---|---|---|---|---|---|
| | L | 250329 | NiCr20Tl2.4Al1.5Co30 | 0.020 | 0.061 ± 0.005 |
| | L | 250330 | NiCr20Tl2.4Al1.5Fe10Co30 | 0.029 | 0.021 ± 0.001 |
| E | L | 250325 | NiCr20Tl2.4Al1.5 | 0.026 | 0.042 ± 0.011 |
| | | | Maximum values from (4a) and (4b) | ≤0.030 | ≤0.156 |

TABLE 8

Results of the tension tests at room temperature (RT), 600° C. and 800° C. The crosshead speed was $8.33 \cdot 10^{-5}$ 1/s (0.5%/min) for $R_{p0.2}$ and $8.33 \cdot 10^{-4}$ 1/s (5%/min) for $R_m$; KG = grain size. (T: alloy according to the prior art, E: alloy according to the invention, L: melted on the laboratory scale, G: melted on the industrial scale) *) Measurement defective

| | | Batch | Alloy | fh in % | KG in µm | $R_{p02}$ in MPa RT | $R_m$ in MPa RT | $R_{p02}$ in MPa 600° C. | $R_m$ in MPa 600° C. | $R_{p02}$ in MPa 800° C. | $R_m$ in MPa 800° C. |
|---|---|---|---|---|---|---|---|---|---|---|---|
| T | G | 320776 | NiCr20TiAl | 8.97 | 21 | | | | | | |
| T | G | 321863 | NiCr20TiAl | 8.98 | 29 | 885 | 1291 | 785 | 1134 | 475 | 583 |
| T | G | 321426 | NiCr20TiAl | 8.93 | 32 | 841 | 1271 | 752 | 1136 | 481 | 587 |
| T | G | 315828 | NiCr20TiAl | 6.14 | 24 | 862 | 1274 | 763 | 1119 | 472 | 554 |
| T | L | 250212 | NiCr20TiAl (Ref) | 6.76 | 30 | 969 | 1317 | 866 | 1199 | 491 | 608 |
| | L | 250211 | NiCr20Tl2.5Al2C01 | 10.01 | 52 | 921 | 1246 | 811 | 1101 | 468 | 591 |
| | L | 250213 | NiCr20Tl2.5Al2C1 | 7.58 | | 957 | 1322 | 841 | 1176 | 483 | 600 |
| | L | 250214 | NiCr20Tl2.5Al2C2 | 4.79 | 22 | 955 | 1249 | 841 | 1199 | 415 | 522 |
| | L | 250208 | NiCr20Tl2.5Al2Mn1.5 | 8.37 | 30 | 961 | 1269 | 848 | 1165 | 435 | 562 |
| | L | 250210 | NiCr20Tl2.5Al2W5 | 8.79 | 24 | 921 | 1246 | 811 | 1101 | 468 | 591 |
| | L | 250325 | NiCr20Tl2.5Al2Fe7 | 6.85 | 40 | 928 | 1153 | 817 | *) | 432 | 561 |
| | L | 250206 | NiCr20Tl2.5Al2Fe10 | 5.70 | 29 | 960 | 1289 | 863 | 1144 | 413 | 547 |
| | L | 250327 | NiCr20Tl2.5Al2Fe30 | 0.23 | 50 | 936 | 1262 | 829 | 1038 | 391 | 508 |
| | L | 250209 | NiCr20Tl2.5Al2Co10 | 14.66 | 26 | 1009 | 1302 | 878 | 1226 | 526 | 654 |
| | L | 250329 | NiCr20Tl2.4Al1.5Co30 | 11.48 | 35 | 925 | 1282 | 818 | 1101 | 489 | 594 |
| | L | 250330 | NiCr20Tl2.4Al1.5Fe10Co30 | 8.85 | 42 | 865 | 905 | 747 | *) | 474 | 560 |
| E | L | 250326 | NiCr30Tl2.4Al1.5 | 3.47 | 31 | 947 | 1214 | 813 | 1089 | 415 | 554 |
| | | | Minimum values according to Equation (5a) and (5b) | | | | | ≥650 | | ≥390 | |

TABLE 9

Results of the oxidation tests at 800° C. in air after 576 h. (T: alloy according to the prior art, E: alloy according to the invention, L: melted on the laboratory scale, G: melted on the industrial scale)

| | | Batch | Alloy | Test no. | $m_{gross}$ in $g/m^2$ | $m_{net}$ in $g/m^2$ | $m_{spall}$ in $g/m^2$ |
|---|---|---|---|---|---|---|---|
| T | G | 321426 | NiCr20TiAl | 443 | 9.69 | 7.81 | 1.88 |
| T | L | 250212 | NiCr20TiAl (Ref) | 443 | 10.84 | 10.54 | 0.30 |
| | L | 250325 | NiCr20Tl2.5Al2Fe7 | 443 | 10.86 | 10.64 | 0.25 |
| | L | 250206 | NiCr20Tl2.5Al2Fe10 | 443 | 9.26 | 9.05 | 0.21 |
| | L | 250327 | NiCr20Tl2.5Al2Fe30 | 443 | 10.92 | 11.50 | −0.57 |
| | L | 250209 | NiCr20Tl2.5Al2Co10 | 443 | 10.05 | 9.81 | 0.24 |
| | L | 250329 | NiCr20Tl2.4Al1.5Co30 | 443 | 9.91 | 9.71 | 0.19 |
| | L | 250330 | NiCr20Tl2.4Al1.5Fe10Co30 | 443 | 9.32 | 8.98 | 0.34 |
| E | L | 250326 | NiCr30Tl2.4Al1.5 | 443 | 6.74 | 6.84 | −0.10 |

LIST OF REFERENCE NUMBERS

FIG. 1: Volume loss of the pin from NiCr20TiAl batch 320776 according to the prior art as a function of the test temperature, measured with 20 N, sliding path 1 mm, 20 Hz and with the load-sensing module (W). The tests at 25 and 300° C. were carried out for 1 hour and the tests at 600 and 800° C. were carried out for 10 hours.

FIG. 2: Volume loss of the pin from NiCr20TiAl batch 320776 according to the prior art and of the cast alloy Stellite 6 as a function of the test temperature, measured with 20 N, sliding path 1 mm, 20 Hz and with the load-sensing module (n). The tests at 25 and 300° C. were carried out for 1 hour and the tests at 600 and 800° C. were carried out for 10 hours.

Figure 3:
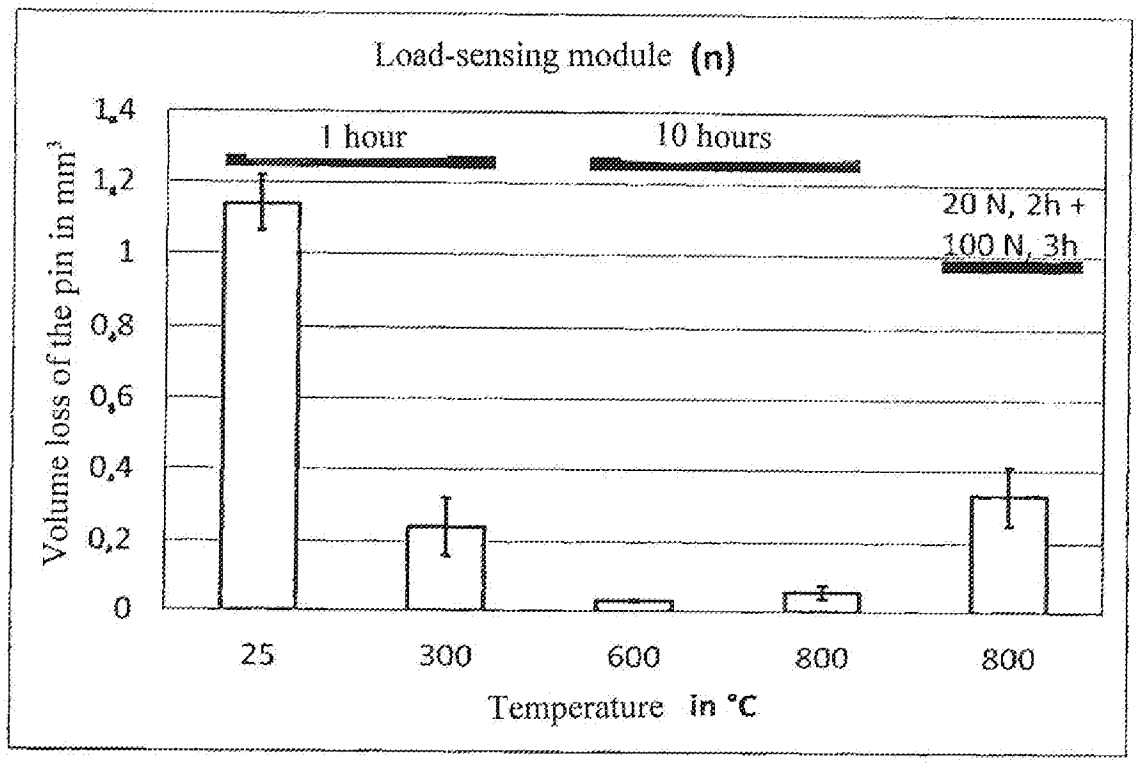

FIG. 3: Volume loss of the pin from NiCr20TiAl batch 320776 according to the prior art as a function of the test temperature, measured with 20 N, sliding path 1 mm, 20 Hz and with the load-sensing module (n). The tests at 25 and 300° C. were carried out for 1 hour and the tests at 600 and 800° C. were carried out for 10 hours. In addition, one test was carried out at 800° C. with 20 N for 2 hours+100 N for 5 hours.

FIG. 4: Volume loss of the pin for various alloys from Table 7 at 25° C., measured with 20 N, sliding path 1 mm, 20 Hz after 1 hour with load-sensing module (a) and (n).

FIG. 5: Volume loss of the pin for alloys with different carbon content from Table 7 in comparison with NiCr20TiAl batch 320776 at 25° C., measured with 20 N, sliding path 1 mm, 20 Hz with load-sensing module (a) after 10 hours.

FIG. 6: Volume loss of the pin for various alloys from Table 7 at 300° C., measured with 20 N, sliding path 1 mm, 20 Hz with load-sensing modules (a) and (n) after 1 hour.

FIG. 7: Volume loss of the pin for various alloys from Table 7 at 600° C., measured with 20 N, sliding path 1 mm, 20 Hz after 10 hours with load-sensing modules (a) and (n).

FIG. 8: Volume loss of the pin for various alloys from Table 7 at 800° C., measured with 20 N for 2 hours followed by 100 N for 3 hours, all with sliding path 1 mm, 20 Hz and with load-sensing module (n).

FIG. 9: Volume loss of the pin for various alloys from Table 7 at 800° C., measured with 20 N for 2 hours followed by 100 N for 3 hours, all with sliding path 1 mm, 20 Hz with load-sensing module (n) together with the sum of Cr+Fe+Co from Formula (1).

FIG. 10: Offset yield strength $R_{p0.2}$ and tensile strength $R_m$ for the alloys from Table 8 at 600° C. (L: melted on the laboratory scale, G: melted on the industrial scale).

FIG. 11: Offset yield strength $R_{p0.2}$ and tensile strength $R_m$ for the alloys from Table 8 at 800° C. (L: melted on the laboratory scale, G: melted on the industrial scale).

FIG. 12: Offset yield strength $R_{p0.2}$ and fh calculated according to Formula 2 for the alloys from Table 8 at 800° C. (L: melted on the laboratory scale, G: melted on the industrial scale).

FIG. 13: Quantitative proportions of the phases at thermodynamic equilibrium as a function of the temperature of NiCr20TiAl on the example of batch 321426 according to the prior art from Table.

The invention claimed is:

1. A valve comprising an age-hardening nickel-chromium-titanium-aluminum wrought alloy, with (in mass-%)

28 to 31% chromium,
1.5 to 3.0% titanium,
1.5 to 2.0% aluminum,
0.005 to 0.10% carbon,
0.0005 to 0.050% nitrogen,
0.0005 to 0.030% phosphorus,
max. 0.010% sulfur,
max. 0.020% oxygen,
max. 0.70% silicon,
max. 2.0% manganese,
max. 0.05% magnesium,
max. 0.05% calcium,
0.01 to 0.04% molybdenum,
0.01 to 0.04% tungsten,
max. 0.1% niobium,
<0.015% copper,
max. 0.5% vanadium,
>3 to 20% Fe,
2 to 12% cobalt,
if necessary 0 to 0.20% Zr,
if necessary 0.0001 to 0.008% boron,
the rest nickel and the usual process-related impurities, wherein the nickel content is greater than 35% and the following relationships must be satisfied:

$$Cr+Fe+Co>33\% \quad (1)$$

and $$fh>0 \text{ with} \quad (2a)$$

$$fh=6.49+3.88Ti+1.36Al-0.301Fe+(0.759-0.0209Co)Co-0.428Cr-28.2C \quad (2)$$

wherein Ti, Al, Fe, Co, Cr and C are the concentrations of the elements in question in mass-% and fh is expressed in %; and $$fver\leq 7 \text{ with} \quad (3a)$$

$$fver=32.77+0.5932Cr+0.3642Mo+0.513W+(0.3123-0.0076Fe)Fe+(0.3351-0.003745Co-0.0109Fe)Co+40.67Ti*Al+33.28Al^2-13.6TiAl^2-22.99Ti-92.7Al+2.94Nb \quad (3)$$

wherein Cr, Mo, W, Fe, Co, Ti, Al and Nb are the concentrations of the elements in question in mass-% and fver is expressed in %; and wherein the valve has a specific gross change in mass of less than 9.26 g/m$^2$ after an oxidation test at 800° C. in air after 576 hours.

2. The valve according to claim 1, wherein the alloy has a carbon content of 0.01 to 0.10%.

3. The valve according to claim 1, wherein the alloy contains an iron content of >3 to 15.0%.

4. The valve according to claim 1, wherein the alloy has a content of boron of 0.0005 to 0.006%.

5. The valve according to claim 1, in which the nickel content of the alloy is greater than 40%.

6. The valve according to claim 1, in which the nickel content of the alloy is greater than 45%.

7. The valve according to claim 1, in which the nickel content of the alloy is greater than 50%.

8. The valve according to claim 1, wherein $$Cr+Fe+Co\geq 48.6\% \quad (1a)$$

wherein Cr, Fe and Co are the concentrations of the elements in question in mass-%.

9. The valve according to claim 1, wherein $$fh\geq 1 \text{ with} \quad (2b)$$

$$fh=6.49+3.88Ti+1.36Al-0.301Fe+(0.759-0.0209Co)Co-0.428Cr-28.2C \quad (2)$$

wherein Ti, Al, Cr, Fe, Co and C are the concentrations of the elements in question in mass-% and fh is expressed in %.

10. The valve according to claim 1, wherein optionally the following elements may also be present in the alloy:

Y 0-0.20% and/or
La 0-0.20% and/or
Ce 0-0.20% and/or
Ce mixed metal 0-0.20% and/or
Hf 0-0.20% and/or
Ta 0-0.60%.

11. The valve according to claim 1, wherein the impurities are adjusted in contents of max. 0.002% Pb, max. 0.002% Zn, max. 0.002% Sn.

* * * * *